US010341776B2

(12) United States Patent
Park et al.

(10) Patent No.: US 10,341,776 B2
(45) Date of Patent: Jul. 2, 2019

(54) ELECTRONIC DEVICE

(71) Applicant: LG ELECTRONICS INC., Seoul (KR)

(72) Inventors: Seungjong Park, Seoul (KR); Youchang Kim, Seoul (KR); Teahoon You, Seoul (KR); Dongyun Hyun, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/685,847

(22) Filed: Aug. 24, 2017

(65) Prior Publication Data

US 2018/0063642 A1 Mar. 1, 2018

(30) Foreign Application Priority Data

Aug. 24, 2016 (KR) ..... 10-2016-0107917

(51) Int. Cl.
*H04R 1/10* (2006.01)
*H04R 5/033* (2006.01)

(52) U.S. Cl.
CPC ..... *H04R 5/0335* (2013.01); *H04R 1/105* (2013.01); *H04R 1/1066* (2013.01); *H04R 1/1075* (2013.01)

(58) Field of Classification Search
CPC ..... A61F 11/08; A61F 11/12; A61F 11/14; A61F 2011/085; H04R 1/1016;
(Continued)

(56) References Cited

U.S. PATENT DOCUMENTS 5,677,964 A 10/1997 Sun
2008/0123890 A1* 5/2008 Peng ..... H04R 1/1075 381/338

(Continued)

FOREIGN PATENT DOCUMENTS

CN 1303226 7/2001
CN 2525756 12/2002

(Continued)

OTHER PUBLICATIONS

European Patent Office Application Serial No. 17187117.1, Search Report dated May 9, 2018, 12 pages.

(Continued)

*Primary Examiner* — Curtis A Kuntz
*Assistant Examiner* — Julie X Dang
(74) *Attorney, Agent, or Firm* — Lee Hong Degerman Kang & Waimey

(57) ABSTRACT

An electronic device includes a body and a first support coupled to one portion of the body, where the first support extends from the body along a line in a first direction relative to a central axis of the body. The device further includes a second support coupled another portion of the body, where the second support extends from the body along a line in a second direction relative to a central axis of the body, and an ear loop connecting the first support to the second support. The shape of the ear loop permits coupling with a user's ear, such that the shape of the ear loop changes according to changes in a degree of an angle between the line in the first direction and the line in the second direction.

12 Claims, 40 Drawing Sheets

(58) Field of Classification Search
CPC .... H04R 1/105; H04R 1/1058; H04R 1/1083; H04R 2460/11; H04R 25/656; H04R 1/10; H04R 1/1008; H04R 1/1066; H04R 1/345
USPC ..... 381/380, 381, 370
See application file for complete search history.

(56) References Cited

U.S. PATENT DOCUMENTS

| | | | | |
|---|---|---|---|---|
| 2009/0052719 | A1* | 2/2009 | Fujiwara | H04R 1/105 381/381 |
| 2010/0061581 | A1 | 3/2010 | Soetejo et al. | |
| 2011/0222719 | A1 | 9/2011 | Hagberg et al. | |
| 2013/0343595 | A1* | 12/2013 | Zorkendorfer | H04R 1/10 381/380 |
| 2014/0205125 | A1* | 7/2014 | Triato | H04R 1/1066 381/330 |

FOREIGN PATENT DOCUMENTS

| | | |
|---|---|---|
| CN | 101374363 | 2/2009 |
| CN | 102150437 | 8/2011 |
| CN | 105407423 | 3/2016 |
| EP | 2028874 | 2/2009 |
| JP | 2002112377 | 4/2002 |
| JP | 2008294872 | 12/2008 |
| KR | 100619090 | 8/2006 |
| KR | 200429813 | 10/2006 |
| KR | 1020130097126 | 9/2013 |
| KR | 1020160029524 | 3/2016 |

OTHER PUBLICATIONS

European Patent Office Application Serial No. 17187117.1, Search Report dated Jan. 26, 2018, 12 pages.
Korean Intellectual Property Office Application No. 10-2016-0107917, Office Action dated Feb. 27, 2018, 5 pages.
Korean Intellectual Property Office Application No. 10-2016-0107917, Office Action dated Jul. 31, 2017, 5 pages.
The State Intellectual Property Office of the People's Republic of China Application No. 201710724014.1, Office Action dated Jan. 29, 2019, 9 pages.

* cited by examiner

ELECTRONIC DEVICE

CROSS-REFERENCE TO RELATED APPLICATIONS

Pursuant to 35 U.S.C. § 119(a), this application claims the benefit of earlier filing date and right of priority to Korean Application No. 10-2016-0107917, filed on Aug. 24, 2016, the contents of which are all hereby incorporated by reference herein in its entirety.

BACKGROUND

1. Field

The present disclosure relates to an electronic device formed in an overall shape according to rotation angles of multiple supports fastened to a body thereof so as to be tightly attached to a user's ears.

2. Description of Related Art

Electronic devices may be classified as a mobile/portable terminal and a stationary terminal according to whether or not they are movable. Mobile terminals may be also classified as a handheld terminal and a vehicle mounted terminal according to whether or not it can be directly carried by a user.

Functions of mobile terminals have become diversified. Mobile terminals have functions of performing data transmission and voice communication, capturing images or video through a camera, recording voice, playing music files through a speaker system, and outputting an image or video to a display unit. Some of mobile terminals additionally support an electronic game play function or a multiplayer function. In particular, recent mobile terminals are available to receive multicast signals providing visual content such as broadcast, video, television programs. With diversified functions, such terminals are implemented as multimedia players having complex functions such as capturing images or video, reproducing music or video files, playing games, receiving broadcast signals, and the like. In order to support and increase such functions of terminals, improvements of structural parts and/or software parts of terminals may be considered. Recently, research into wearable type electronic devices which can be worn on a user's body has been conducted.

SUMMARY

According to an aspect of the present disclosure, an electronic device includes: a body; and a wearing part including a first support fastened to one side of the body, a second support fastened to the other side of the body, and an ear loop connected to the first support and the second support and bent at least once along the user's cartilage, wherein the ear loop of the wearing part is changed in shape by adjusting an angle between the first support and the second support on the basis of the body.

The wearing part may be tilted to be tightly attached to an inner side of the user's cartilage.

The ear loop may include: an ear-seated part extending from the other end of the first support and bent to surround an inner side at an upper end of the user's cartilage; and an ear support extending from the ear-seated part and bent to support an inner side at a lower end of the user's cartilage.

The ear-seated part may be convexly bent in a direction away from the body and the ear support may be concavely bent in a direction toward the body.

An ear housing which can be inserted into the user's ear may be fastened to an inner surface of the body.

The ear housing may be fastened to the inner surface of the body such that the ear housing deviates from a central point of the body.

The ear housing may include: a first housing; a second housing whose upper end is fastened to a lower end of the first housing and a lower end is fastened to the inner surface of the body; a nozzle protruding from one side of an upper end of the first housing; and a speaker disposed within the first and second fastened housings, wherein the second housing may form an echo space in an internal space between the speaker and the inner surface of the body.

The body may include a tilting unit fastened to one end of the first support inserted into an upper end of a circumferential surface of the body, and the tilting unit may include: a damper-seated part corresponding to a region in which the first support is rotated and having ridges and valleys repeated along the inside of the first body; a damper member disposed to be in contact with the damper-seated part, deformed in shape when brought into contact with the ridges, and returned to the original shape thereof when brought into contact with the valleys; and a damper controller having one end fastened to the first body and the other end is fastened to the damper member and rotating in the same direction as that of the first support.

The body may include a tilting unit fastened to one end of the first support inserted into an upper end of a circumferential surface of the body, and the tilting unit may include: a damper-seated part corresponding to a region in which the first support is rotated and having ridges and valleys repeated along the inside of the first body; and a damper member disposed to be in contact with the damper-seated part and contracted in length when brought into contact with the ridges and returned to the original length thereof when brought into contact with the valleys.

A waterproof member may be provided between the first support and the body.

The body may include a molding member disposed between the first support and the second support and allowing a cable to be drawn out therethrough, and a drawn-out angle of the cable drawn out through the molding member may range from 25° to 35° with respect to a vertical direction.

The ear housing may include a patterned part disposed to surround a central region of the ear housing.

The electronic device of the present disclosure has the following advantages.

According to at least one of the embodiments of the present disclosure, since an overall shape of the electronic device is deformed according to rotational angles of multiple supports fastened to the body and easily tightly attached to the user's ears, adherence may be enhanced.

According to at least one of the embodiments of the present disclosure, since the body and the ear housing are easily fastened to each other or separated from each other by the fastening member, components disposed within the electronic device may be easily repaired or exchanged. Thus, time required for after-sales service may be shortened and cost may be reduced.

According to at least one of the embodiments of the present disclosure, since a portion of the ear housing in contact with the user's skin is patterned, an area in contact with the user's skin may be reduced, enhancing wearing sensation.

According to at least one of the embodiments of the present disclosure, since the wearing part is bent at least once, when the electronic device is worn on, the rear of a lower end of the user's cartilage, while surrounding an upper end of the user's cartilage, may be supported, enhancing fitting sensation.

According to at least one of the embodiments of the present disclosure, since the rear of a lower end of the user's cartilage is supported, while surrounding an upper end of the user's cartilage, the electronic device worn on the user's ears may be prevented from being arbitrarily released or moved.

According to at least one of the embodiments of the present disclosure, since the waterproof member is disposed between the body and the wearing part, penetration of moisture or a foreign material from an external environment may be prevented in advance, further improving splash resistance.

According to at least one of the embodiments of the present disclosure, since the damper structure using elasticity is provided between the body and multiple supports, a tilt use sensation of the supports fastened to the body and making a rotational operation may be enhanced.

According to at least one of the embodiments of the present disclosure, since an echo space is formed in a rear space of the speaker disposed in the ear housing, sound quality may be enhanced.

According to at least one of the embodiments of the present disclosure, since the circuit board is disposed in any one of the first and second bodies and the battery is disposed in the other, the battery having larger capacity may be disposed to lengthen a use time of the electronic device.

Still further embodiments include an electronic device having a body and a first support coupled to one portion of the body, where the first support extends from the body along a line in a first direction relative to a central axis of the body. The device further includes a second support coupled to another portion of the body, where the second support extends from the body along a line in a second direction relative to a central axis of the body, and an ear loop connecting the first support to the second support. The shape of the ear loop permits coupling with a user's ear, such that the shape of the ear loop changes according to changes in a degree of an angle between the line in the first direction and the line in the second direction.

An additional scope of applicability of the present invention will be understood from the detailed description. It is to be understood that both the foregoing general description and the following detailed description of the preferred embodiments of the present invention are exemplary and explanatory and are intended to provide further explanation of the invention as claimed.

BRIEF DESCRIPTION OF DRAWINGS

The above and other aspects, features, and advantages of the present disclosure will be more clearly understood from the following detailed description taken in conjunction with the accompanying drawings.

DETAILED DESCRIPTION

Figure 1:
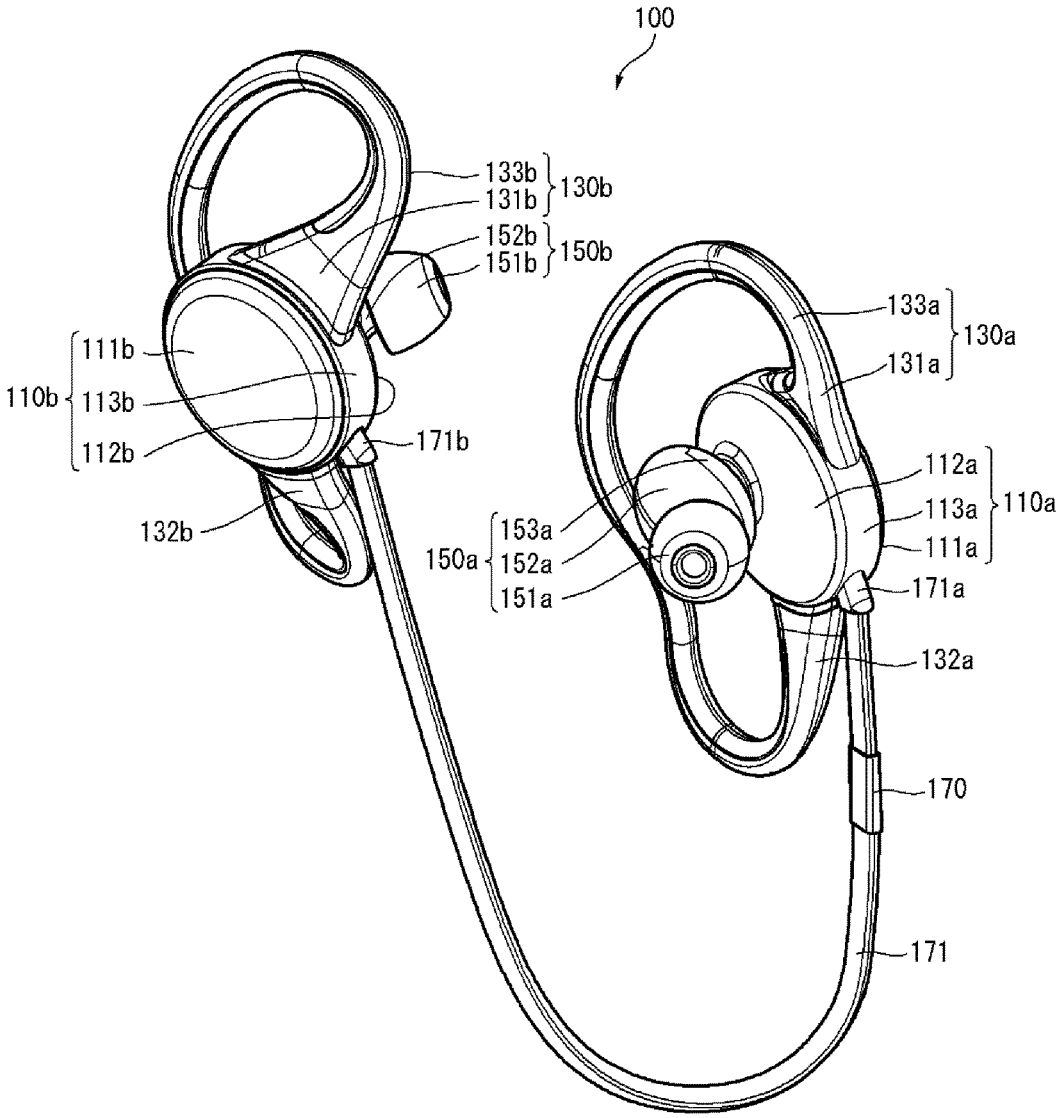
FIG. 1 is a perspective view of an electronic device according to an embodiment of the present disclosure.

Hereinafter, an embodiment of the present invention will be described in detail with reference to the attached drawings. A detailed description of the present invention to be described hereinafter together with the attached drawings describes an embodiment of the present invention and does not represent a sole embodiment in which the present invention may be executed. The following detailed description includes detailed contents in order to provide complete understanding of the present invention. However, a person of ordinary skill in the art knows that the present invention may be executed without such detailed contents.

Reference will now be made in detail embodiments of the invention examples of which are illustrated in the accompanying drawings. Since the present invention may be modified in various ways and may have various forms, specific embodiments are illustrated in the drawings and are described in detail in the present specification. However, it should be understood that the present invention are not limited to specific disclosed embodiments, but include all modifications, equivalents and substitutes included within the spirit and technical scope of the present invention.

The terms 'first', 'second', etc. may be used to describe various components, but the components are not limited by such terms. The terms are used only for the purpose of distinguishing one component from other components. For example, a first component may be designated as a second component without departing from the scope of the present invention. In the same manner, the second component may be designated as the first component.

The term "and/or" encompasses both combinations of the plurality of related items disclosed and any item from among the plurality of related items disclosed.

When an arbitrary component is described as "being connected to" or "being linked to" another component, this should be understood to mean that still another component(s) may exist between them, although the arbitrary component may be directly connected to, or linked to, the second component. In contrast, when an arbitrary component is described as "being directly connected to" or "being directly linked to" another component, this should be understood to mean that no component exists between them.

The terms used in the present application are used to describe only specific embodiments or examples, and are not intended to limit the present invention. A singular expression can include a plural expression as long as it does not have an apparently different meaning in context.

In the present application, the terms "include" and "have" should be understood to be intended to designate that illustrated features, numbers, steps, operations, components, parts or combinations thereof exist and not to preclude the existence of one or more different features, numbers, steps, operations, components, parts or combinations thereof, or the possibility of the addition thereof.

Unless otherwise specified, all of the terms which are used herein, including the technical or scientific terms, have the same meanings as those that are generally understood by a person having ordinary knowledge in the art to which the present invention pertains. The terms defined in a generally used dictionary must be understood to have meanings identical to those used in the context of a related art, and are not to be construed to have ideal or excessively formal meanings unless they are obviously specified in the present application.

The following embodiments of the present invention are provided to those skilled in the art in order to describe the present invention more completely. Accordingly, shapes and sizes of elements shown in the drawings may be exaggerated for clarity.

An electronic device according to an embodiment of the present disclosure may include a cellular phone, a smartphone, a laptop computer, a terminal for digital broadcast, a personal digital assistant (PDA), a portable multimedia player (PMP), a navigation, a slate PC, a tablet PC, an ultrabook, and a wearable device. The wearable device may include a smartwatch, a smart glass, or a head-mounted display (HMD), and the like.

By way of non-limiting example only, further description will be made with reference to particular types of electronic devices. However, such teachings apply equally to other types of terminals, such as those types noted above. In addition, these teachings may also be applied to stationary terminals such as digital TV, desktop computers and a digital signage.

Referring to FIG. 1, an electronic device 100 according to an embodiment of the present disclosure may include bodies 110*a* and 110*b*, wearing parts 130*a* and 130*b*, and ear housings 150*a* and 150*b*.

In the bodies 110*a* and 110*b*, outer surfaces 11*a* and 111*b* and inner surfaces 112*a* and 112*b* may be spaced apart from each other by a predetermined interval and have a predetermined thickness. In the bodies 110*a* and 110*b*, circumferential surfaces 113*a* and 113*b* may be disposed along edges of the outer surfaces 111*a* and 111*b* and edges of the inner surfaces 112*a* and 112*b* and have a predetermined height. A cross-section taken along between the outer surfaces 111*a* and 111*b* and the inner surfaces 112*a* and 112*b* of the bodies 110*a* and 110*b* may have a polygonal or circular shape. The bodies 110*a* and 110*b* may have a hollow shape. Although not shown, a circuit terminal, a battery, and the like, may be disposed within the bodies 110*a* and 110*b*.

In the bodies 110*a* and 110*b*, at least one button, an input/output port, and the like, may be disposed on any one of the outer surfaces 111*a* and 111, the inner surfaces 112*a* and 112*b*, and the circumferential surfaces 113*a* and 113*b*. The button and the input/output port may be electrically connected to the circuit terminal or the battery.

The bodies 110*a* and 110*b* may include a first body 110*a* and a second body 110*b*. The first body 110*a* may be worn on the user's left ear. The second body 110*b* may be worn on the user's right ear.

The first body 110*a* and the second body 110*b* may be electrically connected by a cable 171. One end of the cable 171 may be inserted into a first molding member 171*a* of the first body 110*a* so as to be connected, and the other end may be inserted into a second molding member 171*b* of the second body 110*b* so as to be connected.

In the cable 171, a remote controller button part 170 capable of controlling the first body 110*a* or the second body 110*b* may be disposed between the first body 110*a* and the second body 110*b*.

The wearing parts 130*a* and 130*b* may include first supports 131*a* and 131*b*, second supports 132*a* and 132*b*, and ear loops 133*a* and 133*b*, respectively. The first supports 131*a* and 131*b* may be fastened to one side of the bodies 110*a* and 110*b*, respectively. The second supports 132*a* and 132*b* may be spaced apart from the first supports 131*a* and 131*b* at a predetermined interval and fastened to the other sides of the bodies 110*a* and 110*b*, respectively. The first supports 131*a* and 131*b* and the second supports 132*a* and 132*b* may be disposed on the circumferential surfaces 113*a* and 113*b* of the bodies 110*a* and 110*b*, respectively.

The ear loops 133*a* and 133*b* are disposed between the first supports 131*a* and 131*b* and the second supports 132*a* and 132*b*, respectively, and one side thereof may be connected to the first supports 131*a* and 131*b* and the other sides thereof may be connected to the second supports 132*a* and 132*b*, respectively. The ear loops 133*a* and 133*b* may be bent one or more times.

In the wearing parts 130*a* and 130*b*, while the first supports 131*a* and 131*b* and the second supports 132*a* and 132*b* rotate on the basis of the bodies 110*a* and 110*b*, angles between the first supports 131*a* and 131*b* and the second supports 132*a* and 132*b* may be controlled within a predetermined range.

The ear housings 150*a* and 150*b* may be disposed in portions of the inner surfaces 112*a* and 112*b* of the bodies 110*a* and 110*b*, respectively. The ear housings 150*a* and 150*b* may protrude from the inner surfaces 112*a* and 112*b* of the bodies 110*a* and 110*b* by a predetermined height so as to be inserted into the user's ears.

Referring to FIGS. 2 to 5, the first body 110*a* according to an embodiment of the present disclosure may include a wireless communication unit 115*a*, an interface unit 116*a*, a memory 117*a*, a controller 118*a*, and the like. All of the components illustrated in FIGS. 2 to 5 are not essential and the electronic device 100 described in this disclosure may have fewer or greater components.

Figure 2:
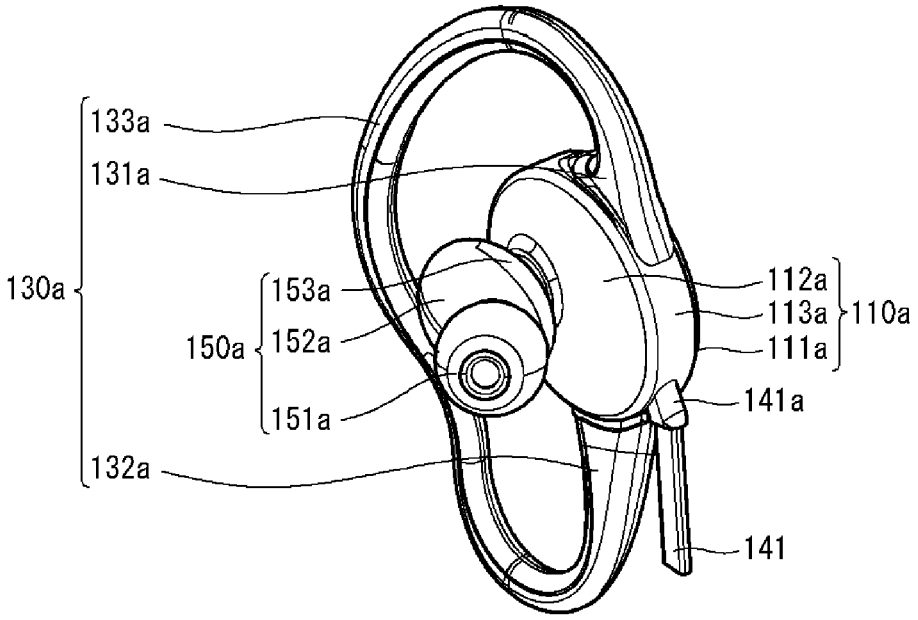
FIG. 2 is a perspective view of a first body among bodies according to an embodiment of the present disclosure.
Figure 3A:
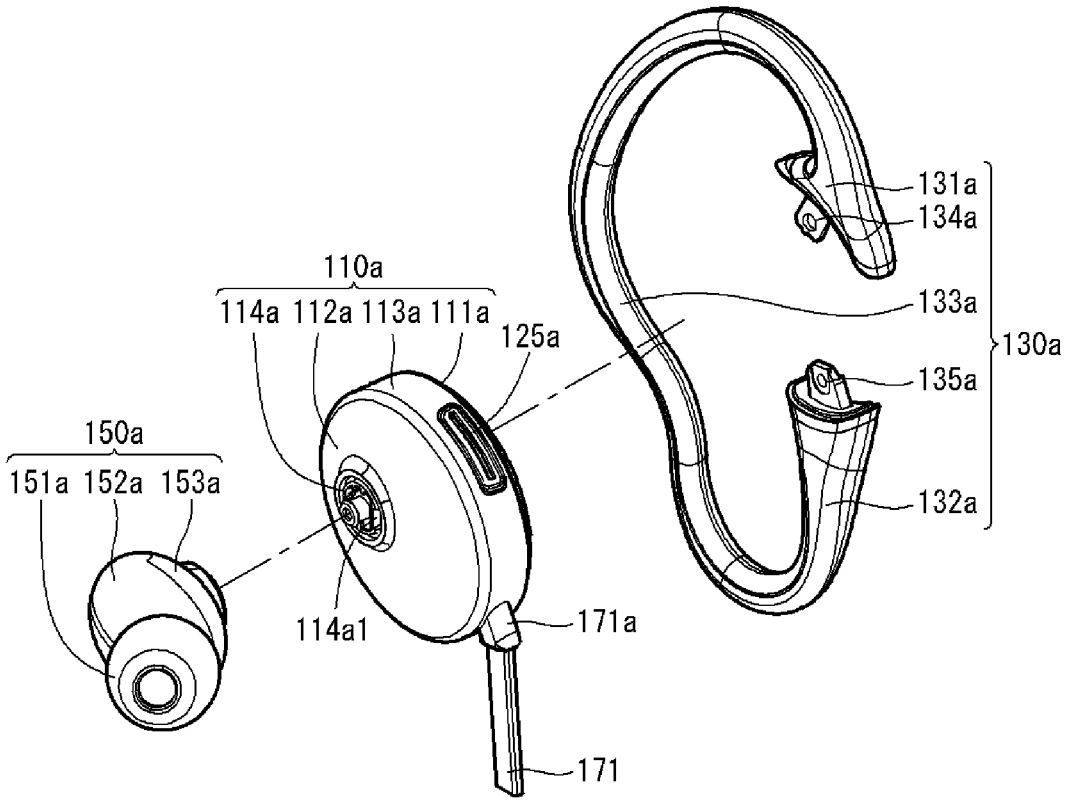
FIG. 3A is an exploded view of FIG. 2.
Figure 3B:
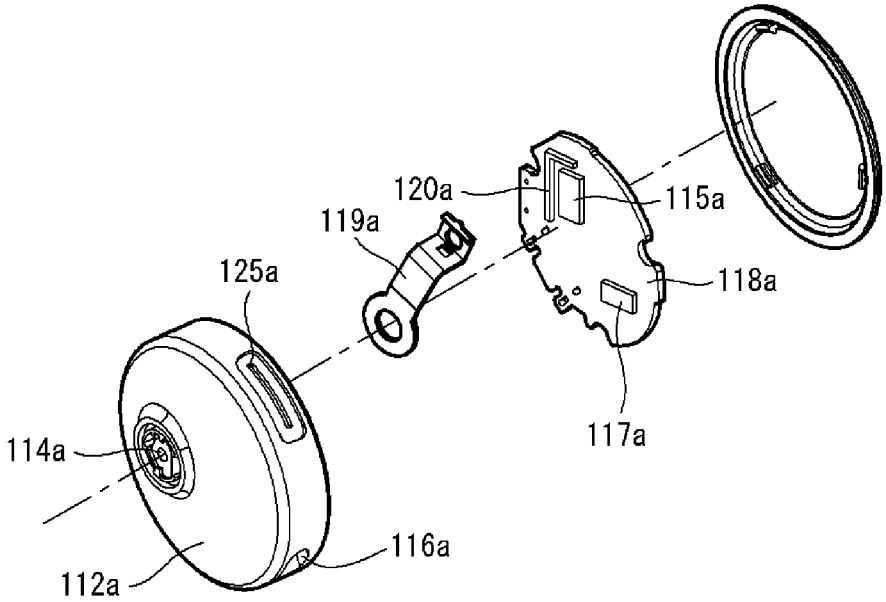
FIG. 3B is an exploded view of a component of FIG. 3A.

Referring to FIGS. 2, 3A, and 3B, the first body 110*a* may include the wireless communication unit 115*a*, the interface unit 116*a*, the memory 117*a*, the controller 118*a*, and a tilting unit 119*a*.

In the first body 110*a*, a housing recess 114*a* fastened to the first ear housing 150*a* may be disposed on an inner surface. In the housing recess 114*a*, at least one anti-rotation member 114*a*1 may be disposed in and protrude from the housing recess 114*a*. The anti-rotation member 114*a*1 may prevent arbitrary rotation of the first ear housing while the first ear housing 150*a* is fastened to the housing recess 114*a*. The anti-rotation member 114*a*1 may guide the first ear housing 150*a* to be fastened to the housing recess 114*a* in an accurate direction.

Also, a first wearing hole 134*a* extending toward the first body 110*a* may be disposed on one end surface of the first support 131*a* of the first wearing part 130*a*, and a second wearing hole 135*a* extending toward the first body 110*a* may be disposed on one end surface of the second support 132*a* of the first wearing part 130*a*. The first wearing hole 134*a* and the second wearing hole 135*a* may be inserted into the first body 110*a* and fastened by a fastening member 160.

The wireless communication unit 115*a* may be disposed within the first body 110*a* of the electronic device 110. The wireless communication unit 115*a* may include one or more modules enabling wireless communication between the electronic device 100 and a wireless communication system, between the electronic device 100 and another electronic device 100, or between the electronic device 100 and an external server. The wireless communication unit 115*a* may include one or more modules connecting the electronic device 100 to one or more networks. The wireless communication unit 115*a* may include at least one of a broadcast mobile communication module, a wireless Internet module, a short-range communication module, and a position information module.

The interface unit 116*a* may be disposed on any one of the outer surface 111*a*, the inner surface 112*a*, and the circumferential surface 113*a* of the first body 110*a*. The interface unit 116*a* may serve as an interface with various types of external devices that can be connected to the electronic device 100. The interface unit 116*a* may include any of an external charger port, a wired or wireless data port, a memory card port, a port for connecting a device having an identification module, and an audio input/output (I/O) port. The electronic device 100 according to an embodiment of the present disclosure may perform appropriate controlling related to a connected external device in response to the external device connected to the interface unit 116*a*. For example, the external charger port may be substantially the same as a charge terminal port of a mobile terminal and the electronic device 100 may be charged through the external charger port, video I/O ports, earphone ports, and the like. In some cases, the mobile terminal 100 may perform assorted control functions associated with a connected external device, in response to the external device being connected to the interface unit 160.

The memory 117*a* stores data supporting various functions of the electronic device 100. The memory 117*a* may store multiple application programs (or applications) driven in the electronic device 100 and data and commands for operations of the electronic device.

The user may download some of a plurality of programs from an external server using wireless communication and store the downloaded programs in the memory 117*a*. The application programs may be stored in the memory 117*a* and may be driven to perform an operation (or function) of the electronic device 100 under the control of the controller 118*a*. The plurality of application programs may include a basic program for operating a basic operation of the electronic device 100. The basic program may be stored in the electronic device 100 at the time when it was released from a factory.

The controller 118*a* may control a general operation of the electronic device 100 in addition to an operation related to an application program. The controller 118*a* may process a signal, data, information, and the like, input/output through the interface unit 116*a* or may drive an application program stored in the memory 117*a*. The controller 118*a* may drive an application program by combining and operating at least two or more components included in the electronic device 100.

The controller 118*a* may be disposed as any one of various types of printed circuit board (PCB) and flexible printed circuit board (FPCB). The controller 118*a* may be implemented by semiconductor packaging, a technology of packaging a chip to apply the chip to a device.

Also, the first body 110*a* may include an antenna 120*a*. The antenna 120*a* may be an antenna for the wireless communication unit 115*a*. The antenna 120*a* may be flexible. When the body 110*a* includes the antenna 120*a*, the wireless communication unit 115*a* is expected to have enhanced transmission/reception capability.

Figure 9:
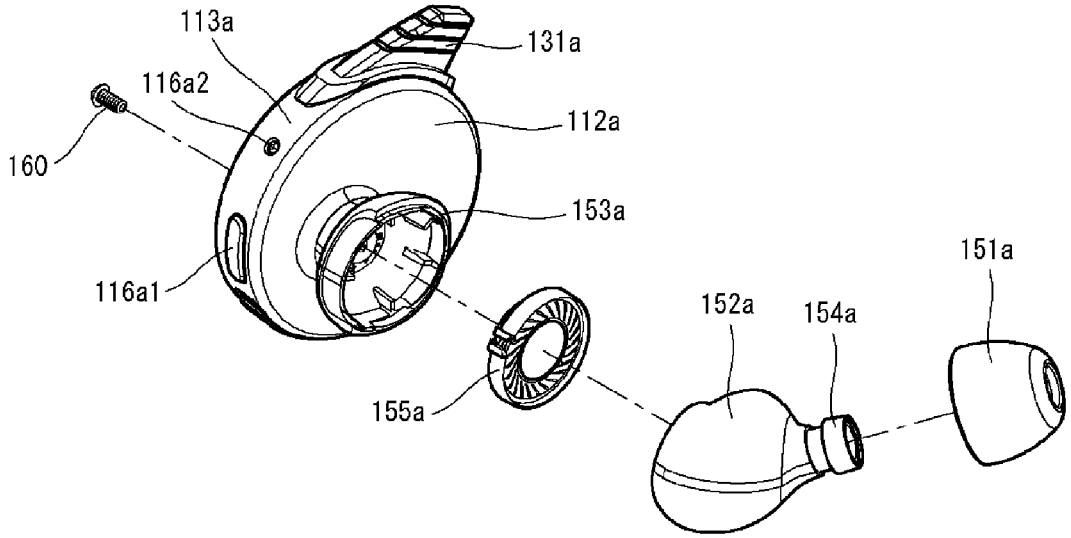
FIG. 9 is an exploded view of FIG. 8.

The tilting unit 119*a* may be fastened to the first support 131*a* of the first wearing part 130*a*. The tilting unit 119*a* may be fastened to one end of the first support 131*a* inserted into an upper end of the circumferential surfaces 113*a* and 113*b* of the bodies 110*a* and 110*b* to control the first support 131*a* to a predetermined tilting angle. The tilting unit 119*a* may be fastened to one end of the first support 131*a* through the fastening member 160 (FIG. 9). The tilting unit 119*a* may control a tilting angle between the first support 131*a* and the second support 132*a*. That is, the tilting angle may include a first tilting angle and a second tilting angle.

Figure 4:
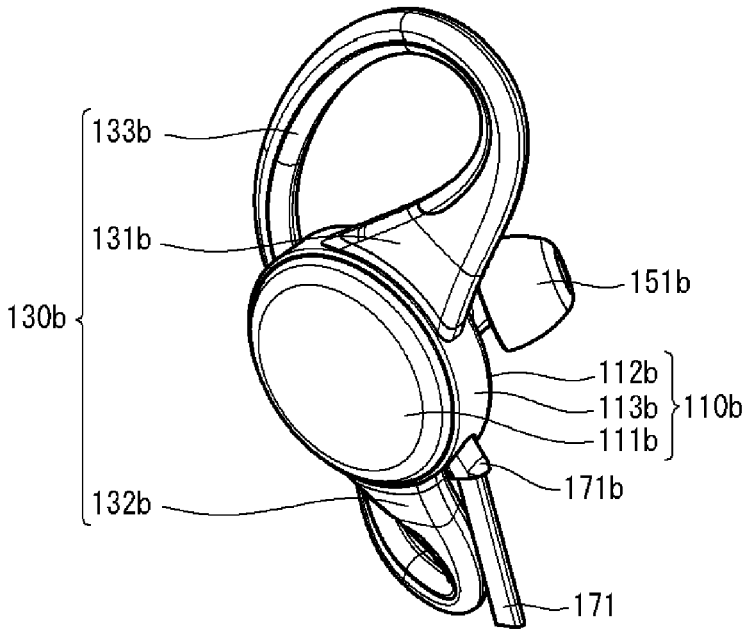
FIG. 4 is a perspective view of a second body among bodies according to an embodiment of the present disclosure.
Figure 5A:
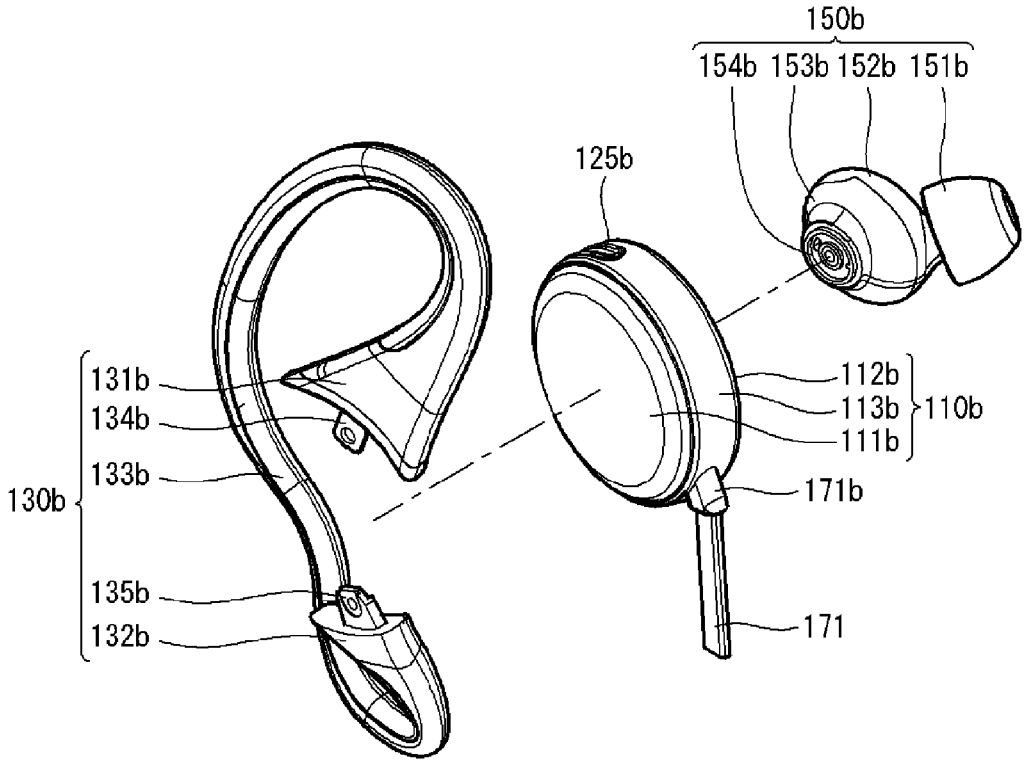
FIG. 5A is an exploded view of FIG. 4.
Figure 5B:
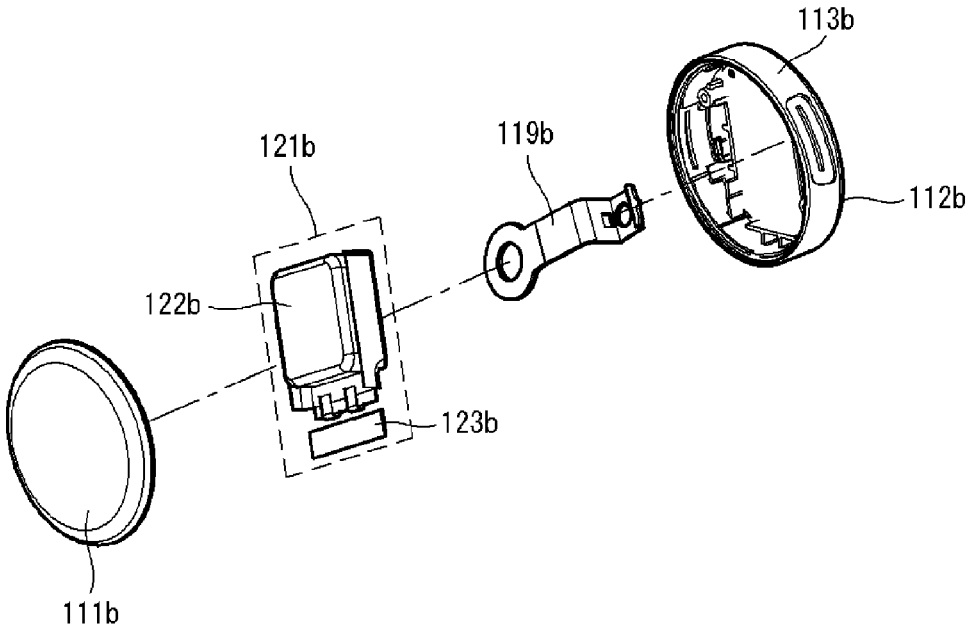
FIG. 5B is an exploded view of a component of FIG. 5A.

Referring to FIGS. 4, 5A, and 5B, the second body 110*b* may include a power supply unit 121*b* and a tilting unit 119*b*.

In the second wearing part 130*b*, a first wearing hole 134*b* extending toward the second body 110*b* may be disposed on one end surface of the first support 131*b*, and a second wearing hole 135*b* extending toward the second body 110*b* may be disposed on one end surface of the second support 132*b*. The first wearing hole 134*b* and the second wearing hole 135*b* may be inserted into the second body 110*b* and fastened by the fastening member 160 (FIG. 9).

The power supply unit 121*b* may be disposed within the second body 110*b*. The second body 110*b* may be electrically connected to the first body 110*a* through the cable 171.

The cable 171 may include at least one line such as a signal line, a power line, and the like.

The power supply unit 121*b* disposed in the second body 110*b* may be provided with external power using a charge port disposed in the first body 110*a* and a power line electrically connected to the first body 110*a* and store the provided external power. The power supply unit 121*b* may supply the stored external power to the controller 118*a*, the wireless communication unit 115*a*, and the like, disposed in the first body 110*a* using the power line. That is, the power supply unit 121*b* may receive power from the outside, store the received power, and supply the stored power to each component included in the electronic device 100 under the control of the controller 118*a*.

The power supply unit 121*b* may include a battery 122*b* capable of storing power. The battery 122*b* may be an internal battery or a replaceable battery.

The power supply unit 121*b* may include a power conversion unit 123*b* converting external power supplied from the outside to internal power. The power conversion unit 123*b* may be disposed in the first body 110*b* and convert external power into internal power which can be stably supplied to each component. Since the power supply unit 121*b* includes the power conversion unit 123*b*, damage to a component or malfunction of a component due to an overvoltage or an abnormal voltage supplied from the outside may be prevented in advance.

As described above, in the electronic device 100 according to an embodiment of the present disclosure, components may be separately disposed in the first body 110*a* and the second body 110*b*. For example, the power supply unit 121*b* and components closely related to the power supply unit 121*b* may be disposed in the second body 110*b*. The other components excluding the power supply unit 121*b* may be disposed in the first body 110*a*. In this manner, since multiple components and the power supply unit 121*b* are separately disposed in the first body 110*a* and the second body 110*b*, respectively, in the electronic device 100, internal space of the second body 110*b* may be easily secured. Thus, the power supply unit 121*b* may include a battery 122*b*. Since the battery 122*b* having capacity as large as the secured internal space is installed in the second body 110*b*, power may be supplied to the electronic device 100 for a longer period of time. Thus, the user may use the electronic device for a longer period of time.

The tilting unit 119*b* may be fastened to the first support 131*b* of the second wearing part 130*b*. The tilting unit 119*b* is substantially the same as the tilting unit 119*a* described above, and thus, descriptions thereof will be omitted.

At least some of the components according to an exemplary embodiment of the present disclosure described so far may operate in conjunction with each other to implement an operation, controlling, or a control method of the electronic device 100 according to various embodiments described hereinafter. Also, an operation, controlling, or a control method of the electronic device 100 according to an embodiment of the present disclosure may be implemented in the electronic device 100 by driving at least one application program stored in the memory 117*a*.

The first wearing part 130*a* may be fastened to the first body 110*a*. The first wearing part 130*a* may be fastened to the first body 110*a* so as to be worn on the user's left ear. The second wearing part 130*b* may be fastened to the second body 110*b*. The second wearing part 130*b* may be fastened to the second body 110*b* so as to be worn on the user's right ear.

The first wearing part 130*a* and the second wearing part 130*b* may be differentiated as being left or right and fastened to the first body 110*a* and the second body 110*b*, respectively, but may substantially have the same shape and function. Thus, for the purposes of description, the first wearing part 130*a* will be representatively described with reference to FIGS. 6 and 7, without distinguishing between the first wearing part 130*a* and the second wearing part 130*b*.

Figure 6:
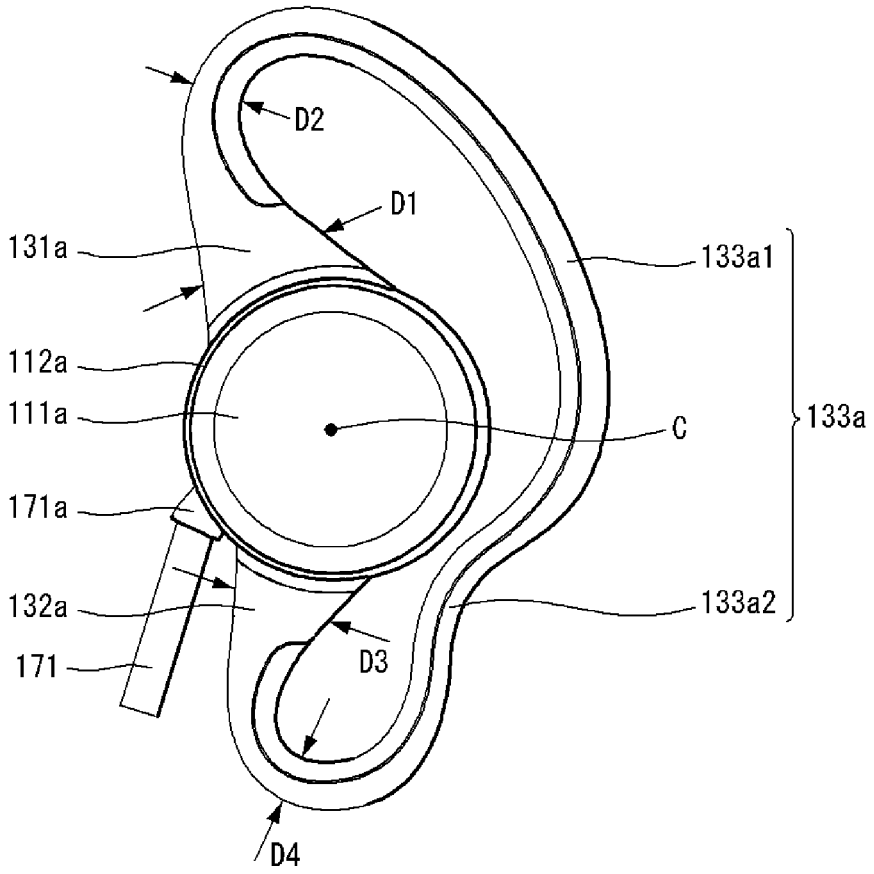
FIG. 6 is a plan view of a wearing part according to an embodiment of the present disclosure.
Figure 7:
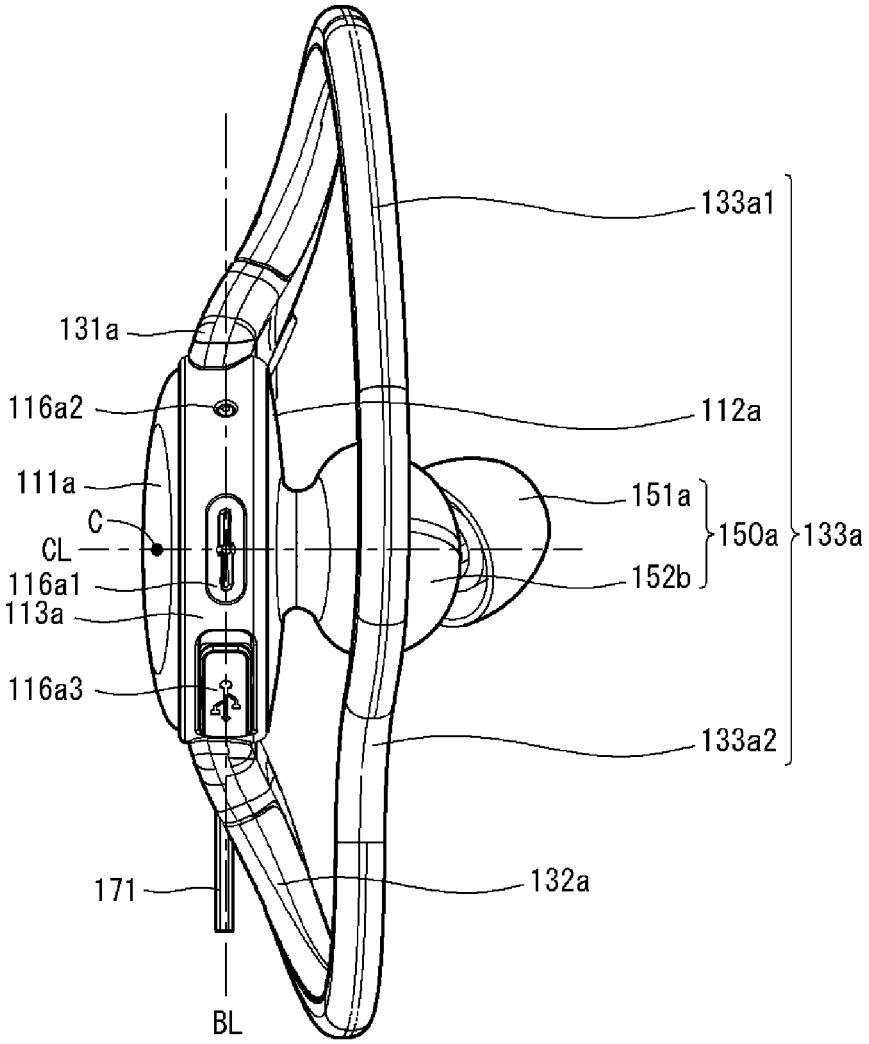
FIG. 7 is a perspective view of a wearing part according to an embodiment of the present disclosure.

Referring to FIGS. 6 and 7, the first wearing part 130*a* according to an embodiment of the present disclosure may include the first support 131*a*, the second support 132*a*, and the ear loop 133*a*. The first wearing part 130*a* may have a shape substantially similar to that of the user's ear in edges thereof.

One end of the first support 131*a* may be fastened to one side of the first body 110*a* and the other end thereof may be connected to the ear loop 133*a*. One end of the first support 131*a* may be disposed on the circumferential surface 113*a* of the body 110*a* and may be disposed at an upper end of the first body 110*a*. A width D1 of a portion of the first support 131*a* fastened to the first body 110*a* may be larger than a width D2 of a portion of the first support 131*a* connected to the ear loop 133*a*.

One end of the second support 132*a* may be fastened to the other side of the first body 110*a* and the other end thereof may be connected to the ear loop 133*a*. One end of the second support 132*a* may be disposed on the circumferential surface 113*a* of the first body 110*a* and disposed at a lower end of the body 110*a*. A width D3 of a portion of the second support 132*a* fastened to the body 110*a* may be larger than a width D4 of a portion of the second support 132*a* connected to the ear loop 133*a*.

Since the widths D1 and D3 of the first and second supports 131*a* and 132*a* are larger than the widths D2 and D4 of the first and second supports 131*a* and 132*a*, the first support 131*a* or the second support 132*a* rarely changes shape during operation, serving to support an overall shape of the first wearing part 130*a*.

The ear loop 133*a* may be connected to the first support 131*a* and the second support 132*a* and bent one or more times. One end of the ear loop 133*a* may be connected to the other end of the first support 131*a* and the other end thereof may be connected to the other end of the second support 132*a*. The ear loop 133*a* may have a shape substantially the same as that of the user's ear.

The ear loop 133*a* may include an ear-seated part 131*a*1 mounted while surrounding the user's earflap and an ear support 133*a*2 supporting a lower end of the user's earflap.

The ear-seated part 133*a*1 extends from the other end of the first support 131*a* and is bent to surround an inner side of an upper portion of the user's ear. The ear-seated part 133*a*1 may be convexly bent in a direction away from a central point C of the first body 110*a* to surround a helix and an inner side of cartilage of the user's ear. The central point C of the body 110*a* may be defined as a point which is the center of the first body 110*a*.

The ear-seated part 133*a*1 may be tilted toward the rear of the user's ear to easily surround the inner side of the upper portion of the user's ear. The ear-seated part 133*a*1 may be tilted to an inner side of the first body 110*a* on the basis of a reference line BL of the first body 110*a*. The reference line BL of the first body 110*a* may be defined as a line passing through a middle portion of the width of the circumferential surface 113*a* disposed between the upper surface 111*a* and the lower surface 112*a* of the first body 110*a*. The reference line BL may intersect with a central line CL extending from the central point C of the first body 110*a* in a first direction.

The ear-seated part 133*a*1 may be put on to surround an inner side of an upper portion of the user's ear, after passing the front of the helix of the user's ear, and thus, the ear-seated part 133*a*1 may be stably worn on the user's ear.

The ear support 133*a*2 may extend from the ear-seated part 133*a*1 and may be bent to support an inner side of a lower portion of the user's ear. The ear support 133*a*2 may be concavely bent toward the central point C of the first body 110*a* to support an inner side where the user's ear lobe and cartilage meet. The ear support 133*a*2 may be bent in more portions than the ear-seated part 133*a*1.

The ear support 133*a*2 may be disposed between the ear-seated part 133*a*1 and the second support 132*a*. The ear support 133*a*2 may extend from the ear-seated part 133*a*1 so as to be connected to the other side of the second support 132*a*.

The ear support 133*a*2 may be tilted toward the rear of the user's ear to more firmly support the inner side of the lower portion of the user's ear. The ear support 133*a*2 may be tilted toward the inner side of the first body 110*a* according to the reference line BL of the first body 110*a*. The ear support 133*a*2 may support the inner side of the lower portion of the user's ear, after passing a lower portion of the lobe of the user's ear, whereby the first wearing part 130*a* may be tightly attached to the user's ear and may not move arbitrarily in the user's ear. In addition, the first wearing part 130*a* includes both the ear-seated part 133*a*1 and the ear support part 133*a*2, arbitrary separation of the first wearing part 130*a* from the user's ear may be prevented in advance. The ear wearing parts 130*a* and 130*b* may stably be worn on the user's ear although the user does exercise such as walking, strolling, cycling, running, and the like, or plays intense sports such as extreme sports.

Also, the first body 110*a* may further include a power button 116*a*1 and an LED indicator 116*a*2. In the first body 110*a*, the power button 116*a*1 and the LED indicator 116*a*2 may be disposed in a region not overlapping the interface unit 116*a*, the first wearing part 130*a*, and the like, disposed on the circumferential surface of the first body 110*a*.

The power button 116*a*1 may turn on or off power of the electronic device 100. When the power button is clicked in a state in which the electronic device 100 is turned off, power of the electronic device 100 may be turned on. Conversely, when the power button is clicked in a state in which the electronic device 100 is turned on, power of the electronic device 100 may be turned off. When the electronic device 100 is turned off by an operation of the power button 116*a*1, information used by the user may be stored in the memory 117*a* under the control of the controller 118*a* before turning off is completed.

The LED indicator 116*a*2 may display a pairing state with a mobile terminal or another electronic device 100 or display a charge state. For example, when the electronic device 100 is normally paired with a mobile terminal or another electronic device 100, the LED indicator 116*a*2 may be displayed in green, and when the electronic device 100 is not paired, the LED indicator 116*a*2 may be displayed in red. Alternatively, when the LED indicator 116*a*2 is being charged through a charge terminal 116*a*3, the LED indicator 116*a*2 may be displayed in yellow. When charging is completed, the LED indicator 116*a*2 may be displayed in green. When charging is not normally performed, the LED indicator 116*a*2 may be displayed in red.

In FIGS. 3A, 3B, 6 and 7, for the purposes of description, the first wearing part 130*a* is described by separating the first support 131*a*, the second support 132*a*, and the ear loop 133*a*, but the first support 131*a*, the second support 132*a*, and the ear loop 133*a* may be formed to have one shape, without being separated.

Figure 8:
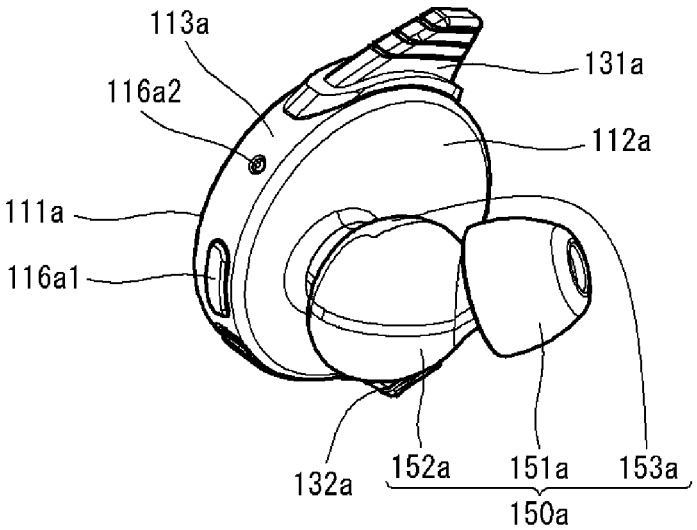
FIG. 8 is a perspective view of an ear housing according to an embodiment of the present disclosure.

Referring to FIGS. 1, 8 and 9, the first ear housing 150*a* may be fastened to the inner surface 112*a* of the first body 110*a*. The first ear housing 150*a* may be fastened to the first body 110*a* so as to be worn on the user's left ear. The second ear housing 150*b* may be fastened to the inner surface 112*b* of the second body 110*b*. The second ear housing 150*b* may be fastened to the second body 110*b* so as to be worn on the user's right ear.

The first ear housing 150*a* and the second ear housing 150*b* may be distinguished as being left or right so as to be fastened to the first body 110*a* and the second body 110*b*, respectively, but may have substantially the same shape and function. Thus, in FIGS. 8 and 9, for the purposes of description, the first ear housing 150*a* will be representatively described, without distinguishing between the first ear housing 150*a* and the second ear housing 150*b*.

The first ear housing 150*a* may include first and second housings 152*a* and 153*a*, an ear cap 151*a*, a nozzle 154*a*, a speaker 155*a*, and a fastening member 160.

The first ear housing 150*a* may include a first housing 152*a* and a second housing 153*a*. The nozzle 154*a* may be disposed on one side of an upper end surface of the first housing 152*a*. A lower end of the first housing 152*a* may be fastened to an upper end of the second housing 153*a*. A lower end surface of the second housing 153*a* may be fastened to the inner surface 112*a* of the body 110*a*. The first ear housing 150*a* may be hollow and a speaker 155*a*, a fastening member 160, and the like, may be disposed therein.

Also, the first housing 152*a* may have a radius that increases from an upper end toward a lower end thereof. That is, the ear housings 150*a* and 150*b* may have a pot shape in which an inlet and a bottom surface thereof are narrow. The shape of the ear housings 150*a* and 150*b* may be defined as a bottleneck shape so as to be easily caught by an antitragus of the user's ear.

The ear cap 151*a* may come into contact with the user's ear. The ear cap 151*a* may be fastened to the nozzle 154*a* as described hereinafter and inserted into a canal of the user's ear. The ear cap 151*a* may be deformed to have a shape similar to that of the canal of the user's ear so as to be tightly attached to the canal of the user's ear. While the user is wearing the electronic device 100, the ear cap 151*a* may appropriately press the canal of the user's ear to block an external sound. The ear cap 151*a* may have elasticity so as to be deformed while being tightly attached to the canal of the user's ear and returned to the original state when it is separated from the canal of the user's ear.

The nozzle 154 may protrude from an upper end surface of the first housing 152*a* so as to be inserted into the canal of the user's ear. The nozzle 154*a* may be disposed to be lopsided on the upper end surface of the first housing 152*a* such that the electronic device 100 worn on the user's ear may be tightly attached to the user's ear. The nozzle 154*a* may transmit a sound output through the speaker 155*a* to the user's ear.

The speaker 155*a* may be disposed within the first ear housing 150*a* and may be disposed between the first housing 152*a* and the second housing 153*a*. The speaker 155*a* may be disposed on an upper end surface of the second housing 153*a*. The speaker 155*a* may be electrically connected to the controller 118*a* disposed within the bodies 110*a* and 110*b*. The speaker 155*a* may convert an electrical signal supplied from the controller 118*a* into sound output.

In addition, when the speaker 155*a* is disposed on the upper end surface of the second housing 153*a*, a rear space of the speaker 155*a* may become an echo space. The echo space may affect sound quality. The echo space may be varied depending on a position and an angle of the speaker 155*a* disposed on the upper end surface of the second housing 153*a*. Thus, the echo space may be varied according to a change in angle between the speaker 155*a* and the nozzle 154*a*. Details thereof will be described in more detail below.

The fastening member 160 may be fastened to the first body 110*a* through a lower end surface of the second housing 153*a*. The fastening member 160 may include a bolt, a screw, and the like, converting a rotational motion into a linear motion. Here, the fastening member 160 is illustrated as a bolt or a screw, but is not limited thereto. Any component may be used as the fastening member 160, as long as it can fasten the second housing 153*a* to the bodies 110*a* and 110*b*.

Figure 10:
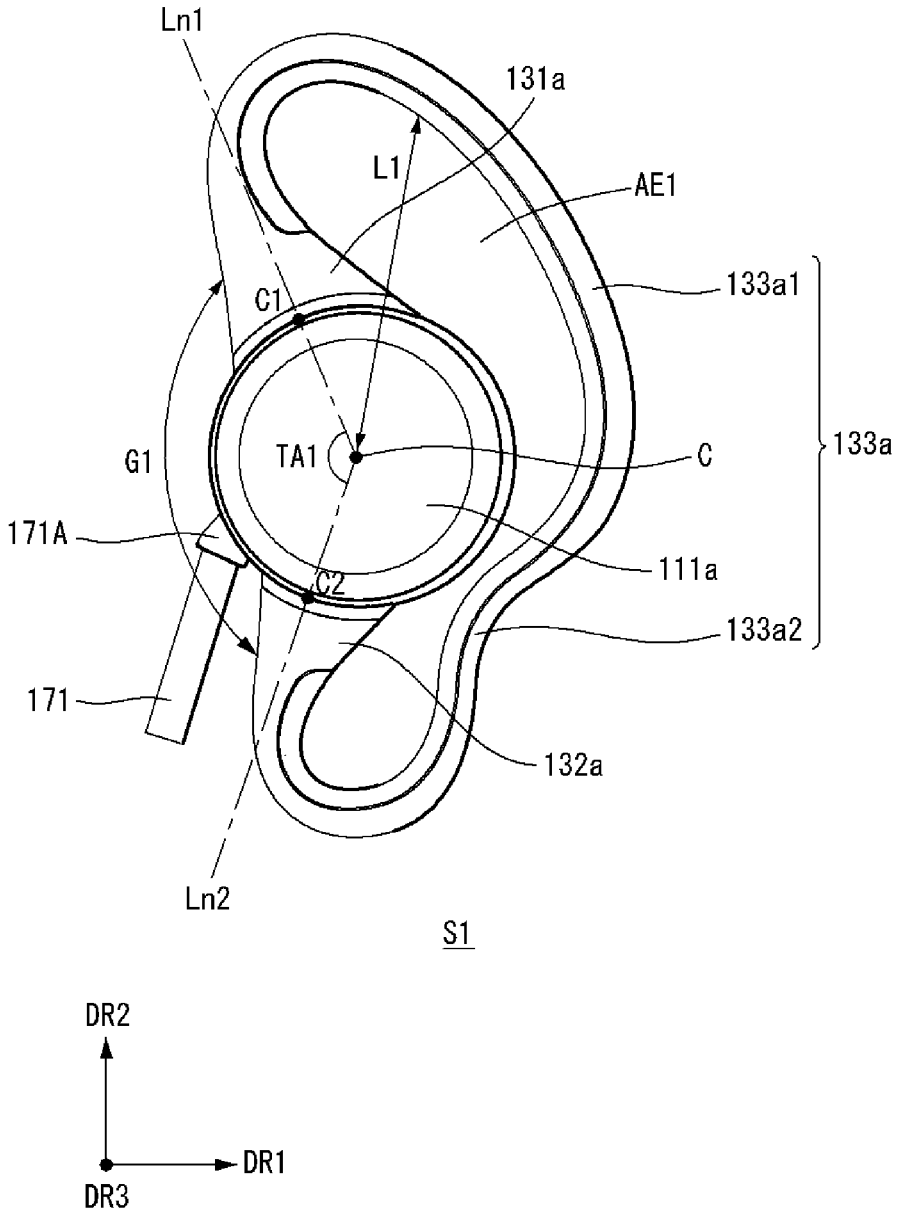
FIGS. 10 and 11 are views illustrating an electronic device operating according to an embodiment of the present disclosure.

Referring to FIG. 10, in the electronic device 100 according to an embodiment of the present disclosure, the first support 131*a* and the second support 132*a* of the first wearing part 130*a* may be in a first state S1. A first direction DR is an X direction as a transverse direction, a second direction DR2 is a Y direction perpendicular to the first direction DR1, and a third direction is a Z direction perpendicular to each of the first direction DR1 and the second direction DR2.

The first state S1 may be defined as a state in which the first support 131*a* and the second support 132*a* are maintained at a first gap G1. Alternatively, the first state S1 may be defined as a state corresponding to a first tilting angle TA between a first line Ln1 formed by linking the central point C1 of the first body 110*a* and a central point C1 at one end of the first support 131*a* and a second line Ln2 formed by linking the central point C of the first body 110*a* and a central point C2 at one end of the second support 132*a*.

When the electronic device 100 is viewed in the third direction DR3, a predetermined area between an outer edge of the first body 110*a* and an inner edge of the first wearing part 130*a* may be visible in the electronic device 100. The predetermined area may be a first area AE1 in the first state S1. Here, in the electronic device 100, a distance L1 from the central point C of the first body 110*a* to the ear-seated part 133*a*1 may be substantially equal to or longer than the user's cartilage.

Figure 11:
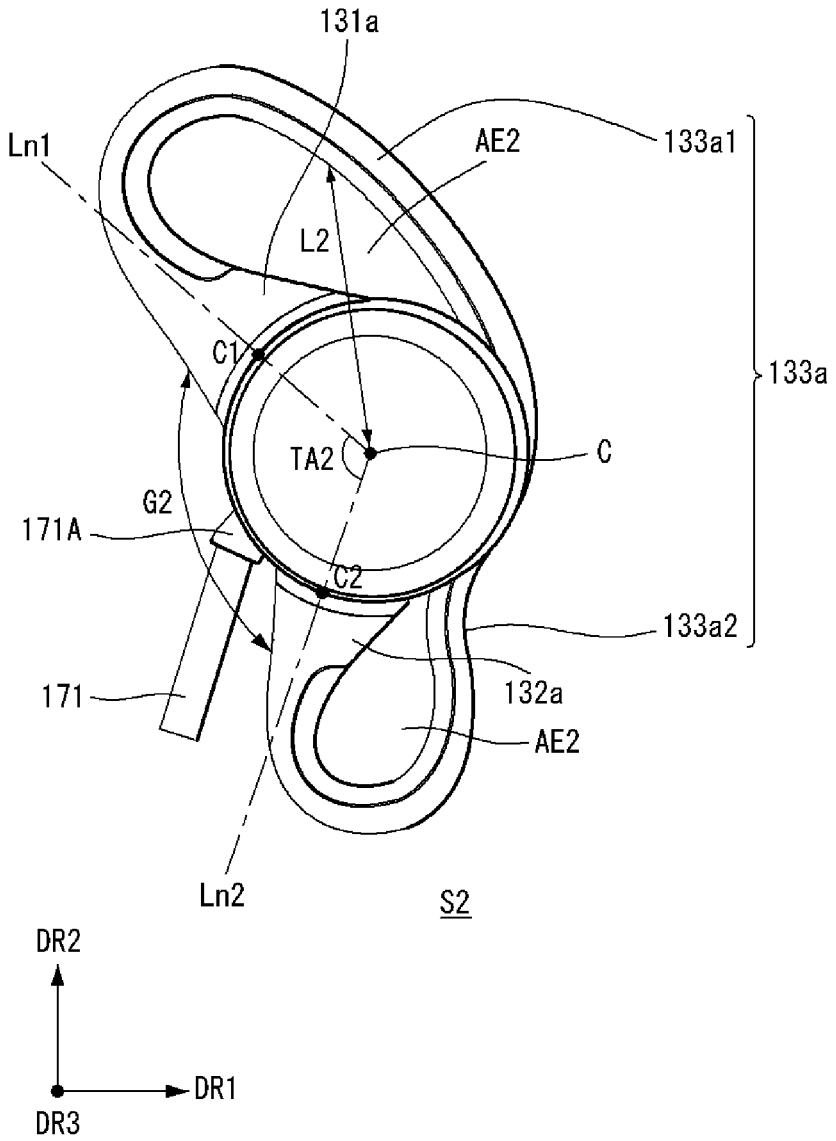

Referring to FIG. 11, in the electronic device 100 according to an embodiment of the present disclosure, the first support 131*a* and the second support 132*a* of the first wearing part 130*a* may be in a second state S2. The second state S2 may be defined as a state in which the first support 131*a* and the second support 132*a* are maintained at a second gap G2. Alternatively, the second state S2 may be defined as a state corresponding to a second tilting angle TA2 between a first line Ln1 formed by linking the central point C1 of the first body 110*a* and a central point C1 at one end of the first support 131*a* and a second line Ln2 formed by linking the central point C of the first body 110*a* and a central point C2 at one end of the second support 132*a*. The second gap G2 is different from the first gap G1. The second gap G2 may be shorter than the first gap G1. The second tilting angle TA1 is different from the first tilting angle TA1. The second tilting angle may be smaller than the first tilting angle.

When the electronic device 100 is viewed in the third direction DR3, a second area AE2 between the outer edge of the first body 110*a* and the inner edge of the first wearing part 130*a* may be visible in the electronic device 100. The predetermined area may be a first area AE1 in the first state S1. Here, in the electronic device 100, a distance L2 from the central point C of the first body 110*a* to the ear-seated part 133*a*1 may be shorter than the user's cartilage. The second area AE2 may be smaller than the first area AE1.

Figure 12:
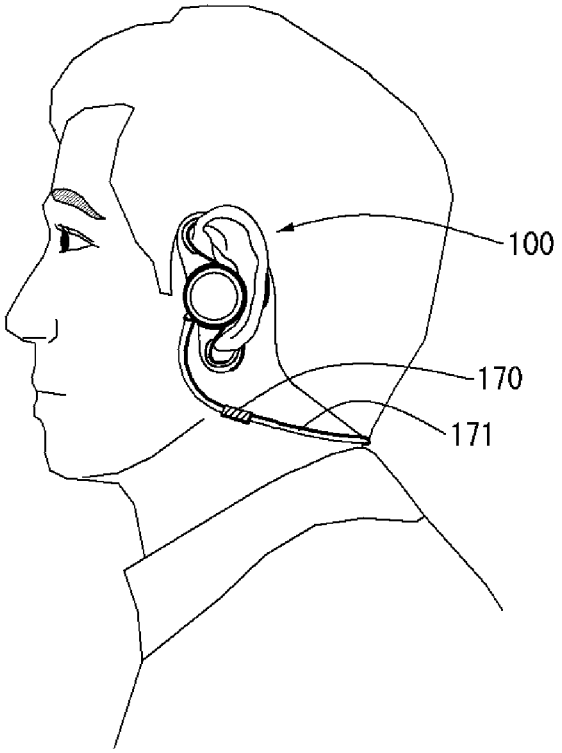
FIG. 12 is a view illustrating a user wearing an electronic device.

Referring to FIG. 12, in the electronic device 100, the first support 131*a* may be rotated at the predetermined tilting angles TA and TA2 with respect to the central point C of the first body 110*a*. Here, the second support 132*a* may be fastened to be fixed to the first body 110*a*. The second support 132*a* may support the overall shape of the electronic device 100, while the first support 131*a* is rotated. When the first support 131*a* is rotated to maintain the first tilting angle TA1 with the second support 132*a*, the electronic device 100 may be in the first state S1, and when the first support 131*a* is rotated to maintain the second tilting angle with the second support 132*a*, the electronic device 100 may be in the second state S2.

The electronic device 100 may be worn on the user's ear in the first state S1. Since the electronic device 100 has the first area AE1 larger than the second area AE2 in the first state S1, the electronic device 100 may be easily put on the user's ear.

After being put on the user's ear, the electronic device 100 may be switched from the first state S1 to the second state S2 by rotating the first support 131*a*. The user may easily rotate the first support 131*a* with his index finger or middle finger. Since the electronic device 100 has the second area AE2 smaller than the first area AE1 in the second state S2, the electronic device 100 may not be easily released or otherwise removed from the user's ear.

In addition, when the electronic device 100 is in the second state S2, the ear-seated part 133*a*1 may be mounted on the inner side of the user's cartilage and the ear support 133*a*2 may support the inner side of a lower end of the user's ear. Accordingly, the electronic device 100 may be tightly attached or otherwise coupled to the user's ear and may not be arbitrarily moved.

Figure 13:
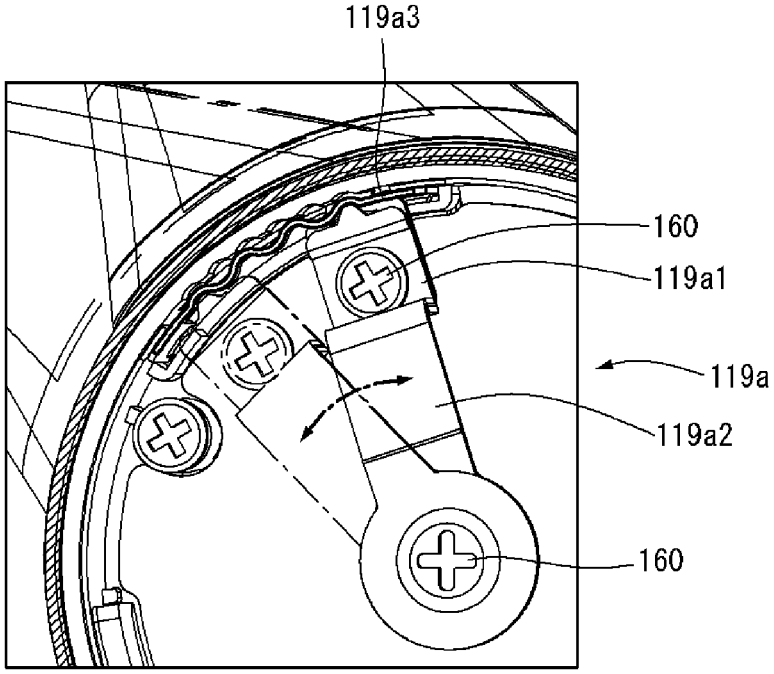
FIG. 13 is a view illustrating an operation in which one side of a first support is fastened to a first body and tilted according to an embodiment of the present disclosure.

Referring to FIG. 13, the tilting unit 119*a* may include a damper member 119*a*1, a damper controller 119*a*2, and a damper-seated part 119*a*3.

The tilting unit 119*a* may be disposed within the first body 110*a* and may be disposed in a position corresponding to the first support 131*a*.

The damper member 119*a*1 may include an elastic material. For example, the damper member 119*a*1 may include a leaf spring.

One end of the damper controller 119*a*2 may be fastened to the first body 110*a* and the other end thereof maybe fastened to an upper end surface of the damper member 119*a*1.

The damper controller 119*a*2 may be fastened to the damper member 119*a*1 by the fastening member 160.

The damper-seated part 119*a*3 may be provided within the first body 110*a* to correspond to a region in which the first support 131*a* is rotated. The damper-seated part 119*a*3 may have a wavy pattern. For example, the damper-seated part 119*a*3 may have a shape in which ridges and valleys are repeated.

The damper-seated part 119*a*3 may be formed of a material different from that of the first body 110*a* and may be formed of a polyacetal material having a smaller relative coefficient of wear/friction as compared to that of the first body 110*a*.

The damper member 119*a*1 may be positioned in a first valley of the plurality of patterns of the damper-seated part 119*a*3. The user may apply force to the first support 131*a* in a clockwise direction. When the force applied to the first support 131*a* exceeds elastic force of the damper member 119*a*1 and the damper controller 119*a*2, the damper member 119*a*1 may be deformed. Thus, the damper member 119*a*1 may be moved to a second valley of the plurality of patterns of the damper-seated part 119*a*3. Through this operation, the damper member 119*a*1 may be moved to a final valley of the plurality of patterns of the damper-seated part 119*a*3. As the damper member 119*a*1 is moved from the first valley to the final valley, the first support 131*a* may be rotated to be switched from the first state S1 to the second state S2.

Figure 14:
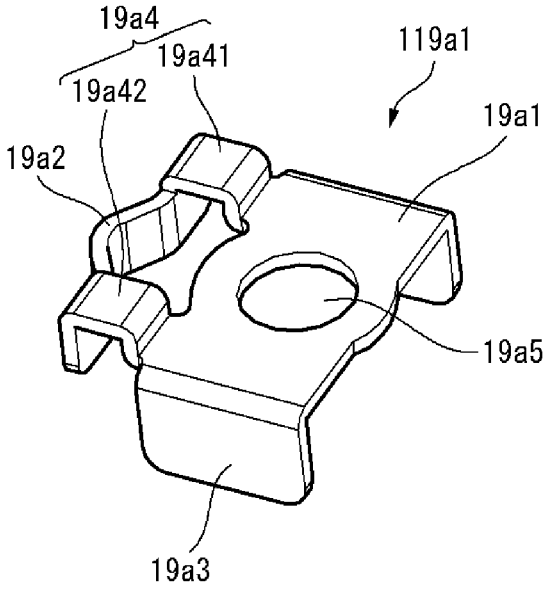
FIG. 14 is a perspective view of a damper member disposed in the first body according to an embodiment of the present disclosure.

Referring to FIG. 14, the damper member 119*a*1 may include a body 19*a*1, a body support member 19*a*3, an elastic member 19*a*2, and a buffer member 19*a*4.

The body 19*a*1 has a quadrangular shape and has a fastening hole 19*a*1 disposed in a central region thereof. The fastening hole 19*a*5 may be disposed to penetrate through the body 19*a*1. The fastening member 160 may penetrate through the fastening hole 19*a*5 to fasten the damper member 119*a* and the damper controller 119*a*2.

The body support member 19*a*3 may be disposed at each of an upper end and a lower end of the body 19*a*1 and extend in a direction which is the same as a direction in which the fastening hole 19*a*5 penetrates through the body 19*a*1.

The elastic member 19*a*2 may be spaced apart from the body 19*a*1 at a predetermined interval. The elastic member 19*a*2 may be bent convexly in a direction away from the body 19*a*1.

The buffer member 19*a*4 may be disposed on a left end side of the body 19*a*1 and extend to be connected to the elastic member 19*a*2. The buffer member 19*a*4 may include a first buffer member 19*a*41 and a second buffer member 19*a*42. The first buffer member 19*a*41 may extend to be connected to one side of an upper end surface of the elastic member 19*a*2. The second buffer member 19*a*42 may be spaced apart from the first buffer member 19*a*41 and extend to be connected to the other side of the upper end surface of the elastic member 19*a*2.

The elastic member 19*a*2 of the damper member 119*a*1 may contact the damper-seated part 119*a*3 and serve as a stopper. That is, the first support 131*a* may be rotated and fixed to a position in which the elastic member 19*a*2 is in contact with the damper-seated part 119*a*3.

The tilting unit 119*a* configured as described above may smoothly perform damping, while the first support 131*a* makes a rotational motion.

Figure 15:
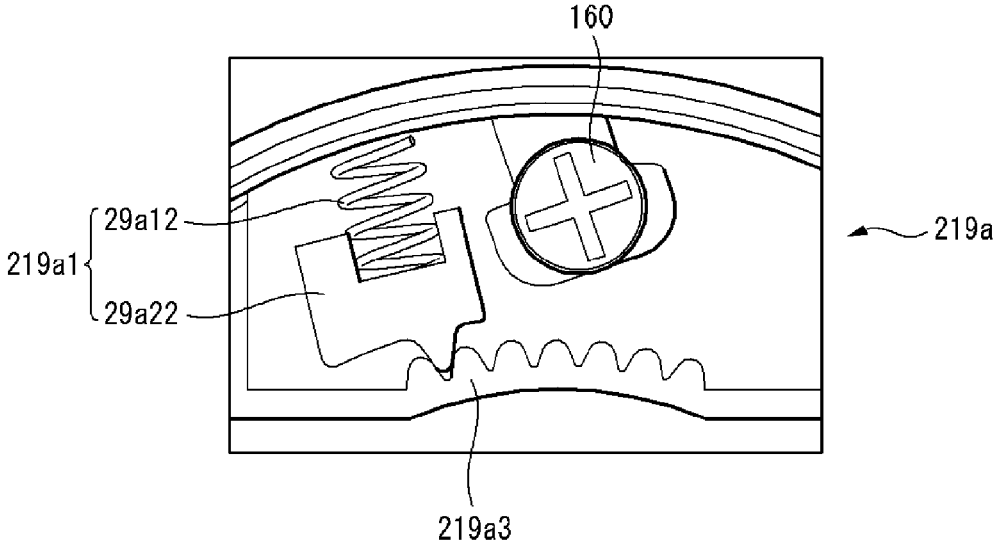
FIG. 15 is a view illustrating an operation in which one side of a first support is fastened to a first body and tilted according to another embodiment of the present disclosure.

Referring to FIG. 15, a tilting unit 219*a* according to another embodiment of the present disclosure may include a damper member 219*a*1 and a damper-seated part 219*a*3.

The tilting part 219*a* may be disposed within the first body 110*a* and may be disposed in a position corresponding to the first support 131*a*.

The damper member 219*a*1 may include a cover member 29*a*22 and an elastic member 29*a* 12. A portion of an upper end surface of the cover member 29*a*22 may protrude. One end of the elastic member 29*a*12 may be inserted and fastened to a lower end surface of the cover member 29*a*22, and the other end thereof may be fastened to the inside of the first body 110*a*.

The elastic member 29*a*12 may include an elastic material. For example, the elastic member 29*a*12 may include an elastic spring. Alternatively, the cover member 29*a*22 may include a rigid material without elasticity.

The damper-seated part 219*a*3 may be formed within the first body 110*a* to correspond to a region in which the first support 131*a* makes a rotational motion. The damper-seated part 219*a*3 may have a wavy pattern. For example, the damper-seated part 219*a*3 may have a shape in which ridges and valleys are repeated.

The damper-seated part 219*a*3 may be formed of a material different from that of the first body and may be formed of a polyacetal material having a relatively smaller coefficient of wear/friction.

The damper member 219*a*1 may be positioned in a first valley of the plurality of patterns of the damper-seated part 219*a*3. The user may apply force to the first support 131*a* in a clockwise direction. When the force applied to the first support 131*a* exceeds elastic force of the damper member 219*a*1 and the damper controller 219*a*2, the damper member 219*a*1 may be deformed. Thus, the damper member 219*a*1 may be moved to a second valley of the plurality of patterns of the damper-seated part 219*a*3. Through this operation, the damper member 219*a*1 may be moved to a final valley of the plurality of patterns of the damper-seated part 219*a*3. As the damper member 219*a*1 is moved from the first valley to the final valley, the first support 131*a* may be rotated to be switched from the first state S1 to the second state S2.

Figure 16:
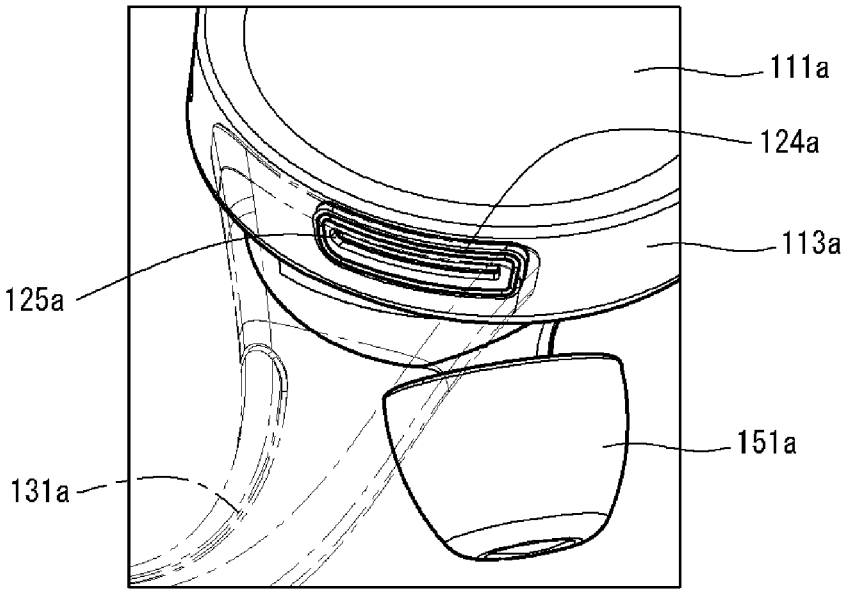
FIG. 16 is a view illustrating a waterproof member according to an embodiment of the present disclosure.

Referring to FIG. 16, in the first body 110*a*, a first support recess 125*a*, into which one end of the first support 131*a* is inserted, may be disposed on an upper side of the circumferential surface 113*a*. Although not shown in FIG. 16, a second support recess, into which one end of the second support 132*a* is inserted, may be disposed on a lower side of the circumferential surface 113*a*.

A waterproof member 124*a* may be disposed between the first support 131*a* and the first body 110*a*. The waterproof member 124*a* may be disposed on one surface of the first support recess 125*a* such that the first support recess 125*a* may not be exposed outwardly.

The waterproof member 124*a* may include a material preventing or inhibiting moisture or foreign material from permeating inwardly. For example, the waterproof member 124*a* may include silicon, rubber, and the like, having high water repellency.

Since the waterproof member 124*a* having high water repellency is disposed on one surface of the first support recess 125*a*, an introduction of moisture or a foreign material to the first body 110*a* through the support recess, while the first support 131*a* is being rotated to the first state S1 or the second state S2, may be prevented.

The waterproof member 124*a* may have at least one protrusion extending from an upper surface in contact with one end surface of the first support 131*a*. Here, the protrusion may be rib shaped. Since the waterproof member 124*a* has the protrusion on the upper surface thereof, moisture or a foreign material permeating through between the first support 131*a* and the first body 110 may be more easily blocked. In addition, since a contact area of the first support 131*a* with respect to the first body 110*a* is reduced by the protrusion of the waterproof member 124*a*, the first support 131*a* may be easily rotated to the first state S1 or the second state S2.

Figure 17:
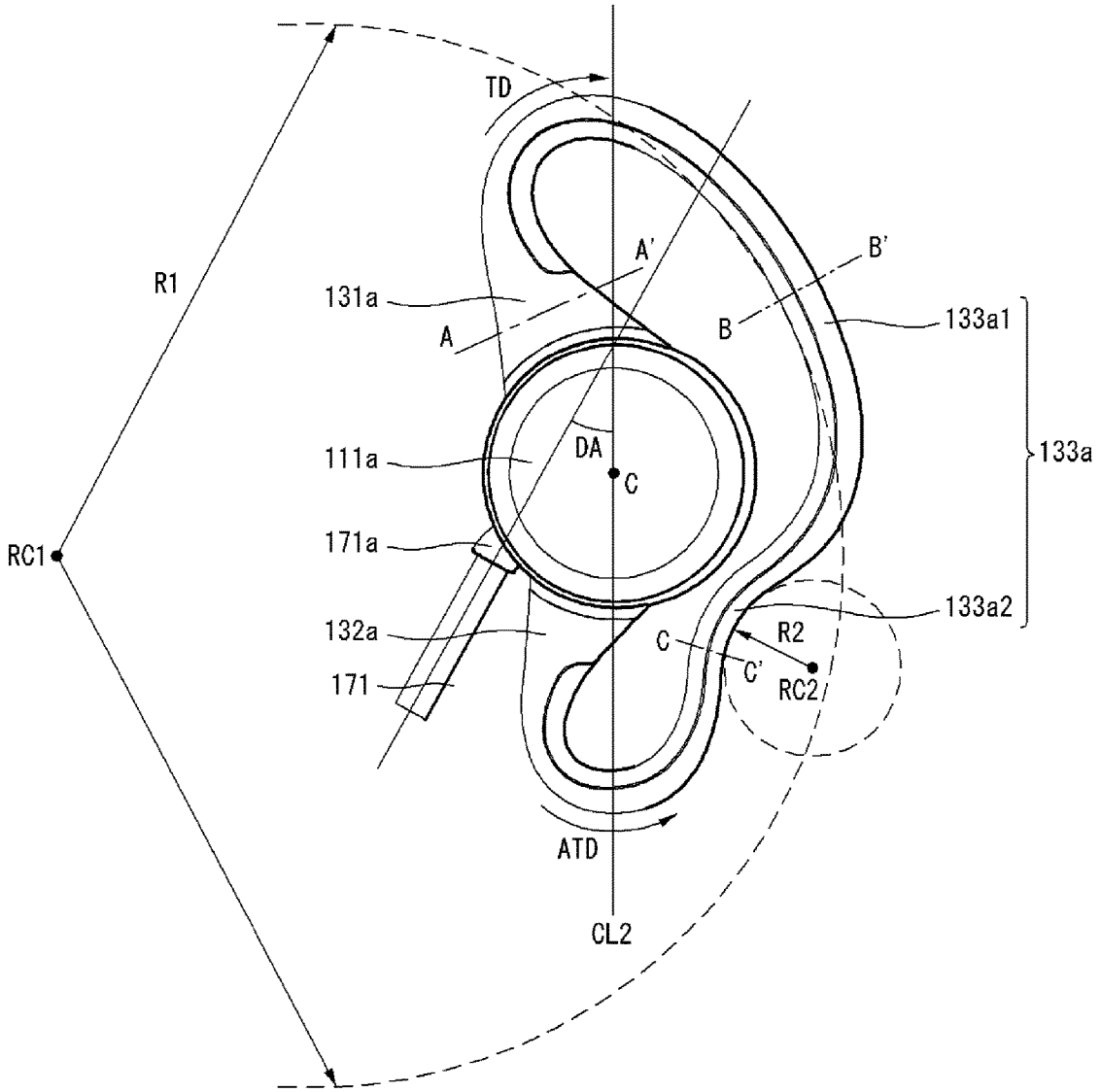
FIG. 17 is a view illustrating a thickness and a width of a first wearing part according to an embodiment of the present disclosure.

Referring to FIGS. 17 and 18, the electronic device 100 according to an embodiment of the present disclosure may include the first support 131*a*, the second support 132*a*, and the ear loop 133*a*.

One end of each of the first and second supports 131*a* and 132*a* may be fastened to the first body 110*a*. One end of each of the first and second supports 131*a* and 132*a* may be increased in width wh1 toward the first body 110*a*, and may be rounded along the circumferential surface 113*a* of the first body 110*a*. Thus, the first and second supports 131*a* and 132*a* may be stably fastened to the first body 110*a*. The other end of the first support 131*a* may be bent at a predetermined angle in a clockwise direction TD. The other end of the second support 132*a* may be bent at a predetermined angle in a counterclockwise direction ATD.

The ear loop 133*a* may include an ear-seated part 133*a*1 and an ear support 133*a*2. One end of the ear-seated part 133*a*1 may be connected to the other end of the first support 131*a*, and the other end thereof may be connected to one end of the ear support 133*a*2. One end of the ear support 133*a*2 may be connected to the other end of the ear-seated part 133*a*1 and the other end thereof may be connected to the other end of the second support 132*a*.

The ear-seated part 133*a*1 may be rounded with a first radius of curvature R1 to surround the user's ear. A central point RC1 of the first radius of curvature R1 may be disposed to be spaced apart to be away from the ear-seated part 133*a*1 in a direction toward the first body 110*a*.

The ear support 113*a*2 may be bent with a second radius of curvature R2 to support an inner side of the user's ear. A central point RC2 of the second radius of curvature R2 may be disposed to be spaced part to be close from the first body 110*a* in a direction toward the ear support 133*a*2.

The first radius of curvature RC1 may be greater than the second radius of curvature RC2. Thus, the ear-seated part 133*a*1 may be bent more gently than the ear support 133*a*2.

Also, in the first body 110*a*, the first molding member 171*a*, from which the cable 171 may be drawn out, may be disposed between the first support 131*a* and the second support 132*a*. The first molding member 171*a* may guide a drawn-out angle of the cable 171 from the first body 110*a*. The drawn-out angle DA of the cable 171 may be defined as an angle at a point where a second central line CL2 passing through the central point C of the first body 110*a* in a vertical direction and the cable 171 drawn out and extending from the first molding member 171*a* intersect with each other.

The drawn-out angle DA of the cable 171 may range from 25° to 35°. If the drawn-out angle DA is less than 25°, the cable 171 may interfered with the first wearing part 130*a*. If the drawn-out angle DA is greater than 35°, a fixing structure disposed within the first body 110*a* to fix the first molding member 171*a* may be increased in size.

The first molding member 171*a* may be bent such that the cable 171 may be naturally drawn out toward a lower end of the first body 110*a*. Also, the cable 171 may include a thermoplastic elastomer (TPE) material. The cable 171 including the TPE material may be drawn out through the first molding member 171*a* and naturally oriented downward.

Figure 18A:
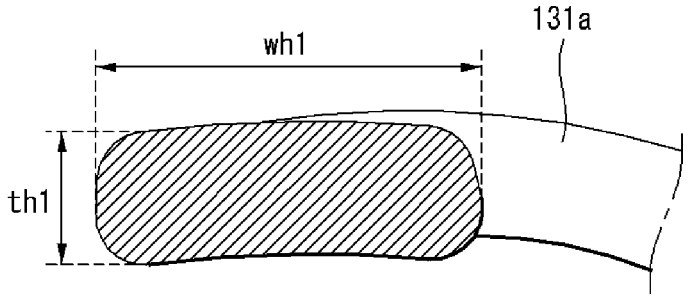
FIGS. 18A, 18B, 18C are views illustrating a thickness of an ear loop of a first support and a second support according to an embodiment of the present disclosure.
Figure 18B:
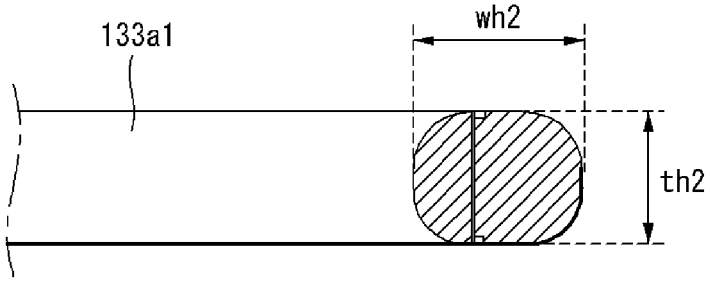
Figure 18C:
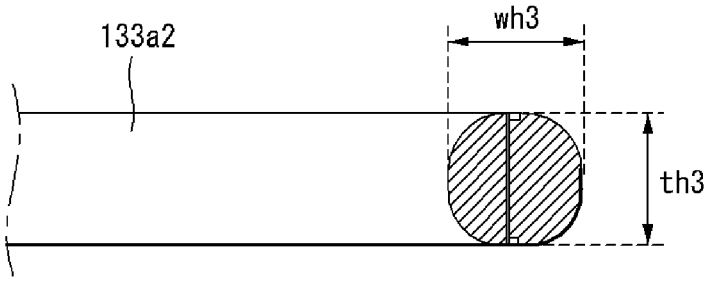

FIG. 18A is a cross-sectional view of one end of the first and second supports 131*a* and 132*a*, taken along line A-A' of FIG. 17. The first and second supports 131*a* and 132*a* may have a first width wh1 and a first thickness th1. FIG. 18B is a cross-sectional view of the ear-seated part 133*a*1, taken along line B-B' of FIG. 17. The ear-seated part 133*a*1 may have a second width wh2 and a second thickness th2. FIG. 18C is a cross-sectional view of the ear support 133*a*2, taken along line C-C'. The ear support 133*a*2 may have a third width wh3 and a third thickness th3.

The first width wh1 may be larger than the second width wh2 and the third width wh3. The first width wh1 may be larger by 2-5 times than the second width wh2 and the third width wh3. The first thickness th1 may be greater than the second thickness th2 and the third thickness th3. In this manner, since the first width wh1 and the first thickness th1 of the first and second supports 131*a* and 132*a* are larger and greater than the widths wh2 and wh3 and the thicknesses th2 and th3 of the ear loop 133*a*, the first and second supports 131*a* and 132*a* are rarely changed in shape, while the first support 131*a* is being rotated, supporting the overall shape of the wearing parts 130*a* and 130*b*.

The second width wh2 may be smaller than the first width wh1 and larger than the third width wh3. The second thickness th2 may be smaller than the first thickness th1 and substantially equal to the third thickness th3. In this manner, since the second width of the ear-seated part 133*a*1 is larger than the width wh3 of the ear support part 133*a*2 and smaller than the width wh1 of the first and second supports 131*a* and 132*a*, an overall shape of the ear-seated part 133*a*1 may be easily changed, while the first support 131*a* is being rotated. That is, the ear-seated part 133*a*1 may be changed in overall shape according to tilting angles of the first support 131*a* so as to fit to surround the user's ear, while the first support 131*a* is being rotated.

If the second width wh2 is equal to or larger than the first width wh1, it may be difficult to change an overall shape of the ear-seated part 133*a*1, while the first support 131*a* is being rotated. That is, since the other end of the first support 131*a* is connected to the ear-seated part 133*a*1, a greater amount of force may be required for the rotation as the second width wh2 of the ear-seated-part 133*a*1 increases. In addition, a changed reaction speed of the ear-seated part 133*a*1 may also slow by the increased portion of the second width wh2.

The third width wh3 may be smaller than the first width wh1 and the second width wh2. The third thickness th3 may be smaller than the first thickness th1 and may be substantially equal to the second thickness th2. The ear support 133*a*2 may be connected to the second support 132*a* fastened and fixed to the bodies 110*a* and 110*b* so that an overall shape of the ear support 133*a*2 may rarely be changed. Thus, although the ear support 133*a*2 has a width smaller than that of the ear-seated part 133*a*1, the ear support 133*a*2 may support the inner side of the user's ear.

Also, the ear support 133*a*2 may be disposed in a position lower than the ear-seated part 133*a*1. That is, the ear-seated part 133*a*1 may be seated at an upper end of the user's cartilage, while the ear support 133*a*2 may be disposed to support a lower end of the user's cartilage. Thus, if the ear support 133*a*2 has the same width wh2 as that of the ear-seated part 133*a*1, a relatively larger load may be applied to the user. Thus, preferably, the ear support 133*a*2 has a width smaller than that of the ear-seated part 133*a*1 in order to reduce an overall weight of the ear loop 133*a*, while firmly supporting the inner side of the user's ear.

Figure 19:
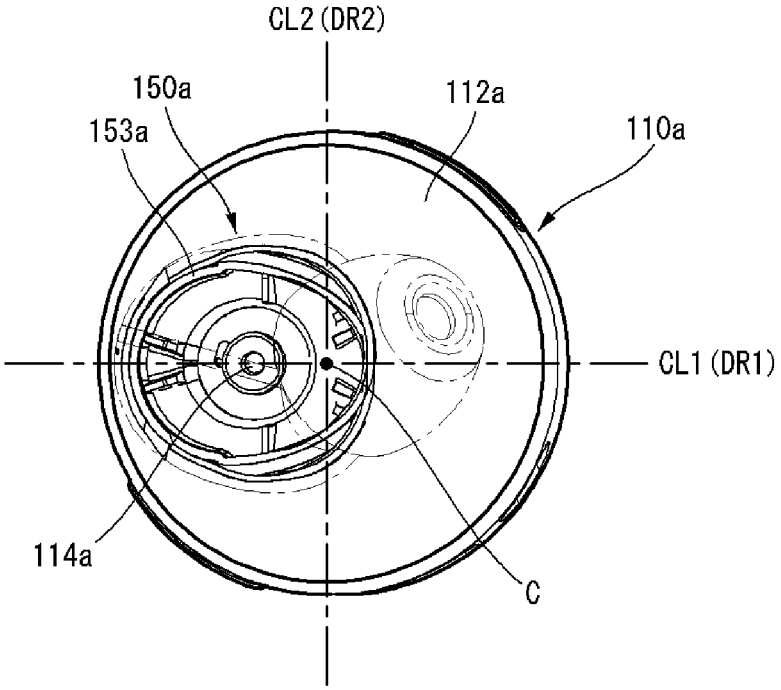
FIG. 19 is a view illustrating a position of a first ear housing fastened to a first body according to an embodiment of the present disclosure.

Referring to FIG. 19, the first housing 153*a* of first ear housing 150*a* may be fastened to the inner surface 112*a* of the first body 110*a*.

The first body 110*a* may include a first central line CL1 passing through the central point C of the first body 110*a* (FIG. 6) in a first direction DR1 and a second central line CL2 passing through the central point of the bodies 110*a* and 110*b* in a second direction DR2 perpendicular to the first direction DR1.

The first ear housing 150*a* may be fastened to deviate from the central point C of the first body 110*a* in the inner surface 112*a* of the first body 110*a*. The first ear housing 150*a* may deviate from the central point C of the first body 110*a* and may be disposed on the first central line CL1. The first ear housing 150*a* may be disposed on the left with respect to the second central line CL2. Thus, the first ear housing 150*a* may be disposed to have a hook structure in the first body 110*a*. Here, it is illustrated that the first ear housing 150*a* is disposed on the first central line CL1, but the present disclosure is not limited thereto and the first ear housing 150*a* may be disposed to be adjacent to the first central line CL1.

Also, as described above with reference to FIG. 8, the first ear housing 150*a* may have a pot shape in which an inlet and a bottom surface are narrow. That is, the shape of the first ear housing 150*a* may be a bottleneck shape so as to be easily caught by the antitragus of the user's ear.

Since the first ear housing 150*a* has a bottleneck shape and is fastened to deviate from the central point C of the first body 110*a*, the first ear housing 150*a* may be accurately caught by the antitragus of user's ears. Thus, when the user wears the electronic device 100, the ear cap 151*a* of the first ear housing 150*a* may be easily inserted into the canal of the user's ear and the first ear housing 150*a* may be accurately put on the antitragus. Also, when the user removes the electronic device 100, the first ear housing 150*a* may be naturally released from the canal and the antitragus of the user's ear.

Figure 20:
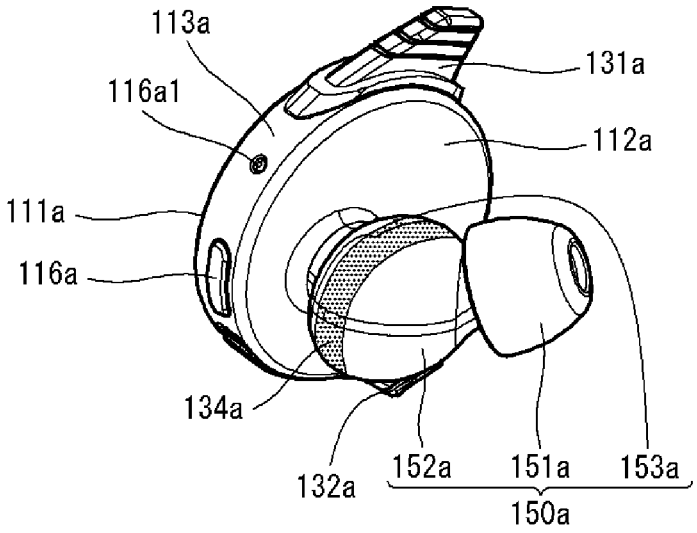
FIG. 20 is a view illustrating a first ear housing patterned according to an embodiment of the present disclosure.

Referring to FIG. 20, the first ear housing 150*a* may have a patterned part 134*a* surrounding a central region of the ear housing 150*a* and having a predetermined width. The patterned part 134*a* may surround a lower end of the first housing 152*a* and an upper end of the second housing 153*a* by a predetermined width. The patterned part 134*a* may have at least one protrusion protruding with a predetermined height. The patterned part 134*a* may be disposed in a portion which comes into contact with the user's skin when the first ear housing 150*a* is caught by the antitragus. Since the first ear housing 150*a* has the pattern part 134*a* in a portion which comes into contact with the user's skin, an area directly in contact with the user's skin may be minimized. In this manner, since the contact area of the first ear housing 150*a* which comes directly into contact with the user's skin is reduced, the ear canal may be appropriately pressed and wearing sensation may be improved. Thus, the user may wear the electronic device 100 for a long period of time.

Figure 21A:
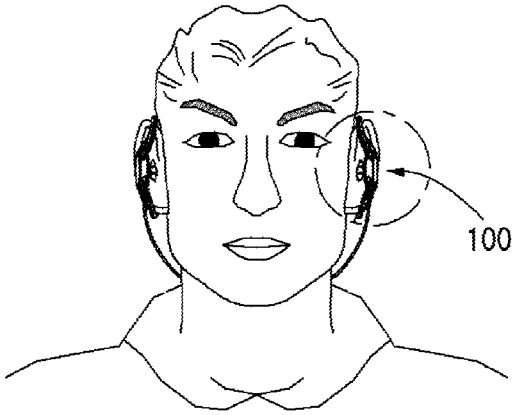
FIGS. 21A, 21B are views illustrating a first ear housing fastened to a user's ear according to an embodiment of the present disclosure.
Figure 21B:
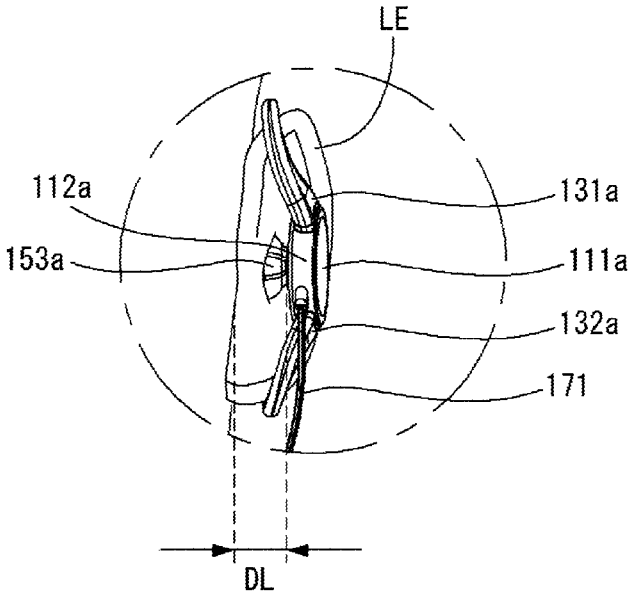

FIG. 21 is a front view illustrating a state in which the user wears the electronic device 100.

When the electronic device 100 is worn on the user's ears, a portion of the first wearing part 130*a* and a portion of the first ear housing 150*a* of the electronic device 100 are in contact with the user's skin. The first body 110*a* of the electronic device 100 may be spaced apart from the user's skin by a predetermined interval DL, without being in contact with the user's skin. In the first body 110*a*, since the first ear housing 150*a* disposed on the inner surface 112*a* has a bottleneck shape, the first body 110*a* may be spaced apart from the user's skin by the predetermined interval DL, rather than being directly in contact with the user's skin.

Also, in the electronic device 100, while the first ear housing 150*a* is seated on the user's ears, the first wearing part 130*a* may be rotated from the first state S1 (FIG. 10) to the second state S2 (FIG. 11). As the first wearing part 130*a* is rotated from the first state S1 to the second state S2, the first support 131*a* may be tilted to a front side of the user. Thus, the electronic device 100 may be further easily tightly attached to the user's ears.

Figure 22:
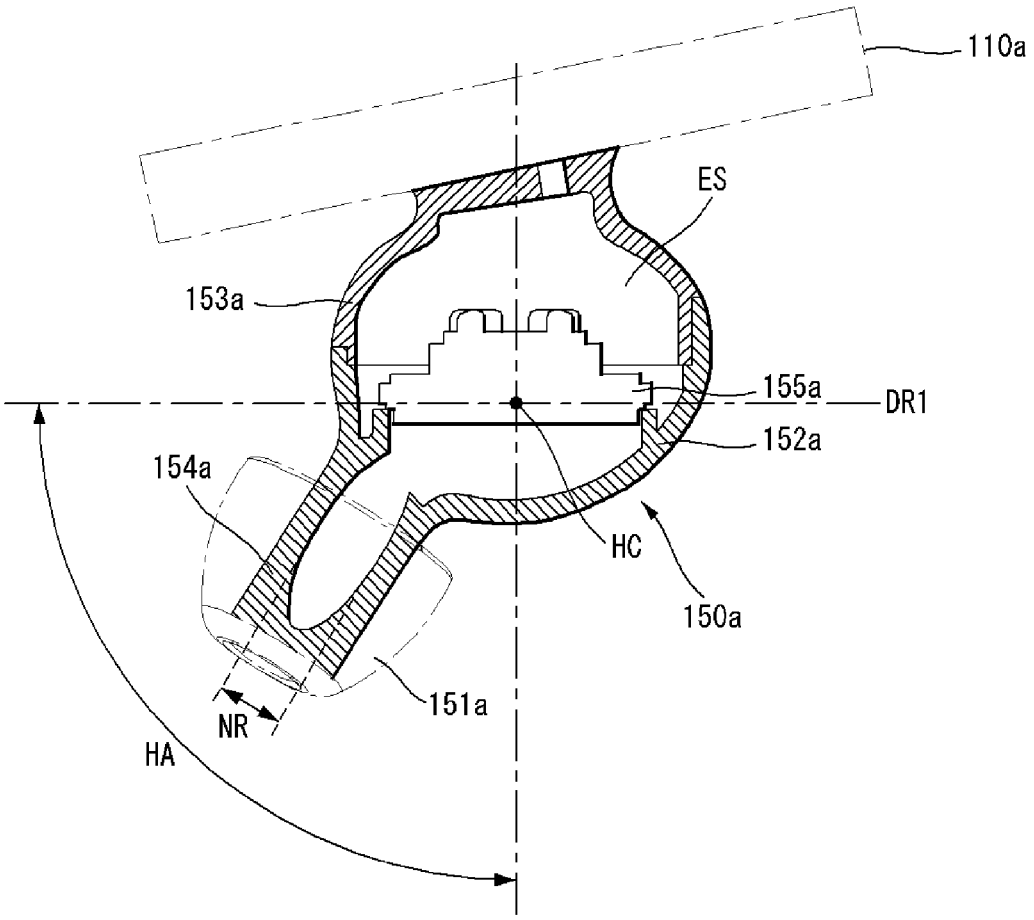
FIG. 22 is a view illustrating an echo space of a first ear housing according to an embodiment of the present disclosure.

FIG. 22 is a cross-sectional view of the first ear housing 150*a*, taken in the second direction.

The first ear housing 150*a* may include the first and second housings 152*a* and 153*a*, the ear cap 151*a*, the nozzle 154*a*, the speaker 155*a*, and the fastening member 160. The first ear housing 150*a* may be fastened to the inner surface 112*a* of the first body 110*a*. The first ear housing 150*a* may be fastened to the first body 110*a* so as to be put on the user's left ear.

The first housing 152*a* may have the nozzle 154*a* disposed on one side of an upper end surface thereof. A lower end of the first housing 152*a* may be fastened to an upper end of the second housing 153*a*. A lower end surface of the second housing 153*a* may be fastened to the inner surface 112*a* of the first body 110*a*. The first ear housing 150*a* may be hollow so the speaker 155*a*, the fastening member 160, and the like, may be disposed therein.

The speaker 155*a*, the ear cap 151*a*, the nozzle 154*a*, and the fastening member 160 have been described above sufficiently, and thus, descriptions thereof will be omitted.

The speaker 155*a* may be disposed between a lower end of the first housing 152*a* and an upper end of the second housing 153*a*. In the second housing 153*a*, the speaker 155*a* may be disposed at the upper end of the second housing 153*a* and the inside of the second housing 153*a* below the speaker 155*a* may be hollow. That is, in the second housing 153*a*, an echo space ES may be provided below the speaker 155*a*. The echo space ES may be provided on the rear side of the speaker 155*a* and affect sound quality output from the speaker 155*a*.

Also, the echo space ES may be varied according to positions, angles, and the like, of the speaker 155*a* disposed at the upper end of the second housing 153*a*. The echo space ES may be varied according to a change in a horizontal angle HA. Here, the horizontal angle HA may be defined as an angle at which the nozzle 154*a* is tilted with respect to a central point HC of the speaker 155*a* in the first direction as a transverse direction. In the first ear housing 150*a*, the horizontal angle HA between the nozzle 154*a* and the speaker 155*a* is set to range from 15° to 25° to move to a band in which a frequency value F0 is low. Here, the frequency value F0 represents a lowest resonance frequency and may indicate a low band frequency limit value of the speaker. Thus, in the electronic device 100, by setting the horizontal angle HA between the nozzle 154*a* and the speaker 155*a* to range from 15° to 25°, a degradation of low band characteristics may be improved.

Also, after the speaker 155*a* of the first ear housing 150*a* is set in the transverse direction, it may move to a higher frequency band of F0 as a radius NR of the nozzle 154*a* is increased. That is, as the diameter NR of the nozzle 154*a* of the electronic device 100 is increased, a register characteristics value may be increased.

In this manner, the electronic device 100 may be designed to have an optimal value of low band characteristics in consideration of the relationship between the horizontal angle HA between the nozzle 154*a* and the speaker 155*a* and the diameter NR of the nozzle 154*a*.

Figure 23:
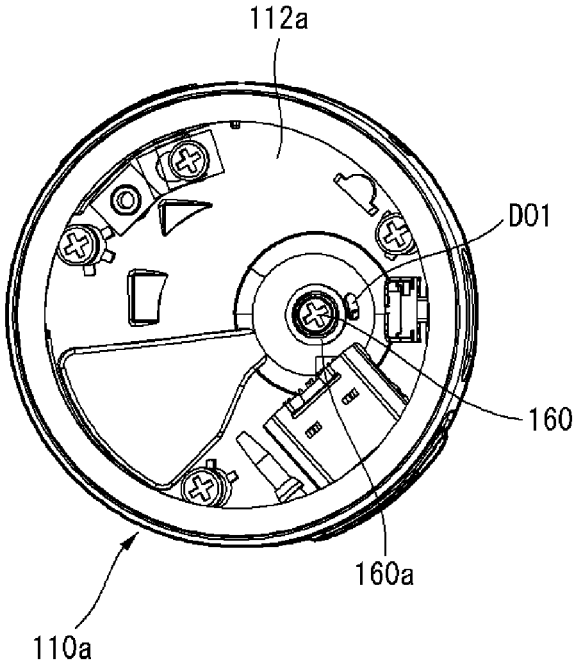
FIG. 23 is a view illustrating a region in which a first ear housing is sealed according to an embodiment of the present disclosure.
Figure 24:
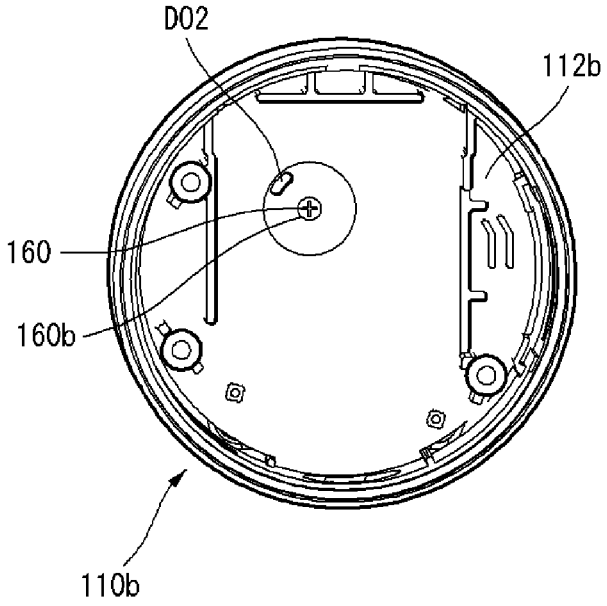
FIG. 24 is a view illustrating a region in which a second ear housing is sealed according to an embodiment of the present disclosure.

Referring to FIGS. 23 and 24, since the wireless communication unit 115*a*, the controller 118*a*, and the like, are disposed in the first body 110*a* (FIG. 3B) and the power supply unit 121*b* is disposed in the second body 110*b* (FIG. 5B), the internal structures of these components are different.

On the inner surface 112*a* of the first body 110*a*, a fastening recess 160*a* is provided, into which the fastening member 160 fastening the second housing 153*a* and the first body 110*a* may be inserted and a first drawn-out recess DO1 from which a signal line electrically connected to the speaker 155*a* is drawn out from the first body 110*a*.

On the inner surface 112*b* of the second body 110*b*, a fastening recess 160*b* is provided, into which the fastening member 160 fastening the second housing 153*a* and the first body 110*b* may be inserted and a second drawn-out recess DO02 from which a signal line electrically connected to the speaker 155*a* is drawn out from the second body 110*b*.

In FIG. 23, the first drawn-out recess DO1 may be disposed on the lower end surface in a corresponding position in consideration of the internal structure of the first body 110*a*, and in FIG. 24 the second drawn-out recess DO02 may be disposed on the lower end surface in a corresponding position in consideration of the internal structure of the second body 110*b*. The first and second drawn-out recesses DO1 and D02 are preferably disposed in portions not affected by the internal structure of the first and second bodies 110*a* and 110*b*.

Also, in the first and second bodies 110*a* and 110*b*, in order to maintain predetermined sound pressure in the echo space ES, a wire is drawn out and the first and second drawn-out recesses DO1 and D02 may be sealed to prevent leakage of sound pressure. Here, in each of the first body 110*a* and the second body 110*b*, a sealing point sealed to the first drawn-out recess DO1 and a sealing point sealed to the second drawn-out recess D02 may differ. In this manner, by differentiating the sealing points in the first and second bodies 110*a* and 110*b*, the echo space ES formed in the second housing 153*a* of the first body 110*a* and the echo space ES formed in the second housing 153*a* of the second body 110*b* may be secured in the same manner. Thus, the first and second bodies 110*a* and 110*b* may realize the same or similar sound quality.

Figure 25:
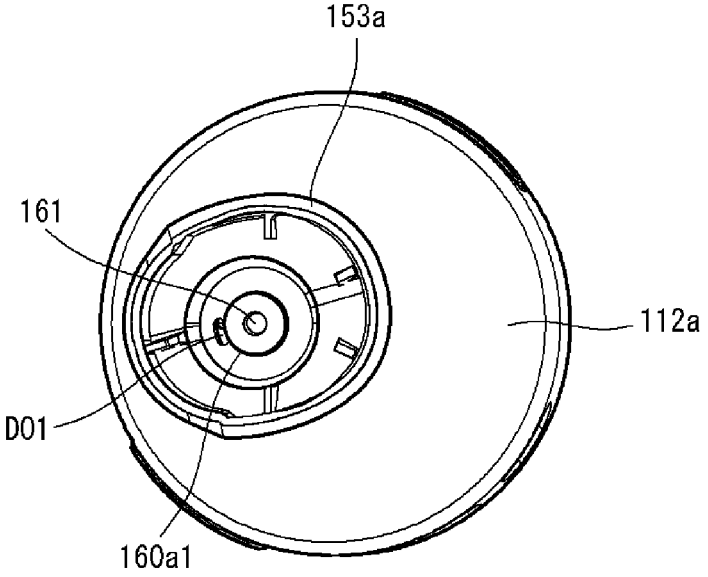
FIG. 25 is a view illustrating a lower surface of a first ear housing according to an embodiment of the present disclosure.

The first body 110*a* may have a fastening recess 160*a* fastened to the fastening member 160 on a lower surface thereof. In FIG. 25, in the second housing 153*a*, a fastening recess 160*a*1 of the second housing 153*a* may be disposed in a position corresponding to the fastening recess 160*a* of the first ear housing 150*a*. Thus, the fastening member 160 may also be fastened to the fastening recess 160*a*1 of the second housing 153*a*.

A fixing member 161 preventing idle running of the fastening member 160 when the fastening member 160 is fastened may be disposed at an upper end of the fastening recess 160*a*1 of the second housing 153*a*. The fastening member 160 may sequentially penetrate through the fastening recess 160*a* of the first body 110*a* and the fastening recess 160*a*1 of the second housing 153*a* so as to be fastened, and finally, fastened to the fixing member 161. Since the fastening member 160 is fastened to the fixing member 161, idle running of the fastening member 160 or arbitrary release of the fastening member 160 from the fastening recess 160*a*1 of the second housing 153*a* may be prevented. Thus, the first ear housing 150*a* may be firmly fixed to the first body 110*a* by the fastening member 160 and the fixing member 161.

Also, since the first ear housing 150*a* is fastened to the first body 110*a* by the fastening member 160, the first ear housing 150*a* may be easily separated. That is, when the first ear housing 150*a* or the first body 110*a* requires replacement or inspection, the first ear housing 150*a* or the first body 110*a* may be separated and only the faulty element may be repaired or replaced.

Figure 26A:
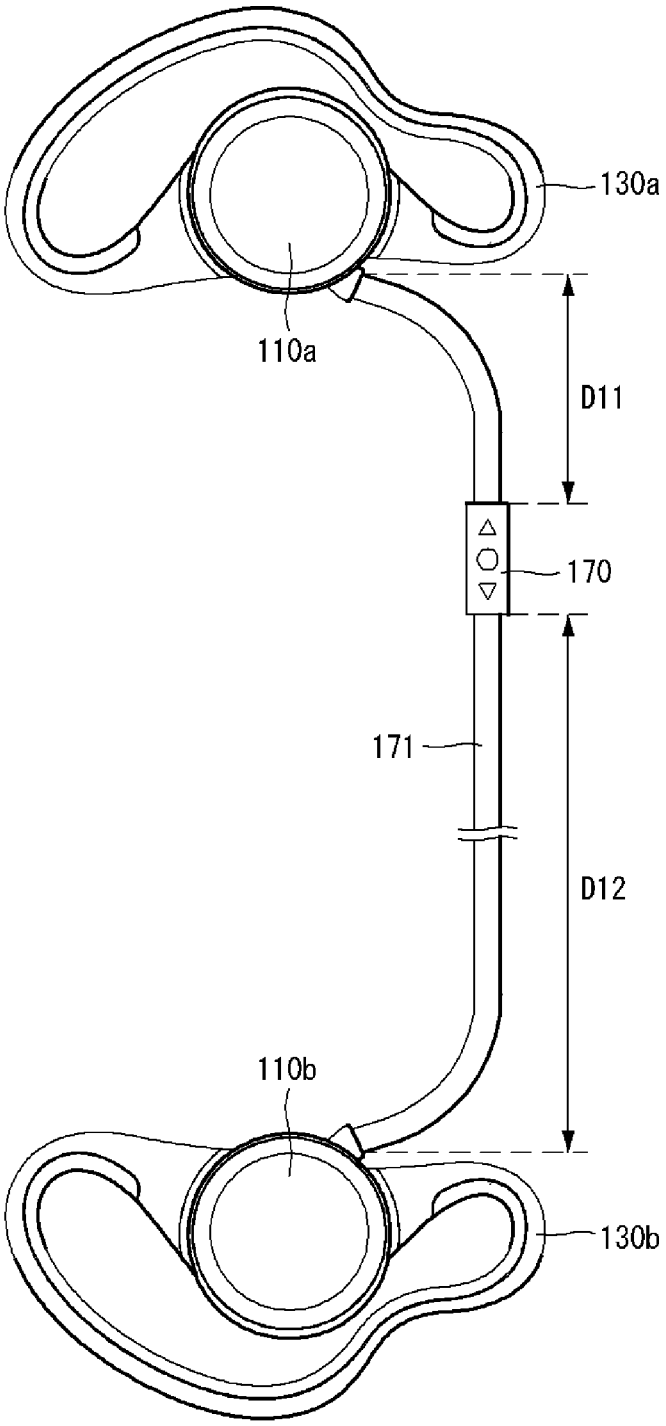
FIGS. 26A, 26B are views illustrating a remote controller button part in an electronic device according to an embodiment of the present disclosure.
Figure 26B:
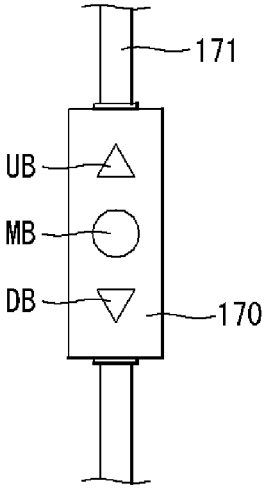

Referring to FIGS. 26A, 26B, the first body 110*a* may be electrically connected to the second body 110*b* through the cable 171. The cable 171 may include at least one line, such as a signal line, a power line, and the like.

The cable 171 may include the remote controller button part 170 for controlling the electronic device 100. The remote controller button part 170 may have at least one button UB, MB, and DB. The at least one button UB, MB, and DB may include a first button UB to a third button DB.

The first button UB may be disposed at an upper end of the remote controller button part 170, and the third button DB may be disposed at a lower end of the remote controller button part 170. The second button MB may be disposed between the first button UB and the third button DB.

The first button UB may raise the volume or select a next piece of music. For example, the volume may be raised one level each time the first button UB is clicked once. Alternatively, when the first button UB is quickly double-clicked, a currently played piece of music may be switched to a next piece of music.

The second button MB may play music or stop playing music, and may answer a call or hang up the phone. For example, when a call is received, the user may click the second button MB to answer the call, and may hang up the phone by clicking the second button MB again. Alternatively, in cases where the user wants to enjoy music, the user may play music by clicking the second button MB and stop playing the music by clicking the second button MB again. Also, when the second button MB is long-clicked, the electronic device 100 may be turned on or off.

The third button DB may lower the volume or select a previous piece of music. For example, the volume may be lowered one level each time the third button DB is clicked. Alternatively, when the third button DB is quickly double-clicked, a currently played piece of music may be switched to a previously piece of music.

The remote controller button part 170 may be disposed between the first body 110*a* and the second body 110*b*, and may be disposed to be closer to the first body 110*a*. A first distance D11 between the remote controller button part 170 and the first body 110*a* may be smaller than a second distance D12 between the remote controller button part 170 and the second body 110*b*.

The remote controller button part 170 may be electrically connected to the controller 118*a* disposed in the first body 110*a*. Thus, as the first distance D11 between the remote controller button part 170 and the controller 118*a* is shorter, a length of a signal line electrically connecting the remote controller button part 170 and the controller 118*a* may be reduced. As a signal line for exchanging signals is shorter, less noise occurs. Thus, the remote controller button part 170 may exchange more accurate signals with the controller 118*a*.

Figure 27:
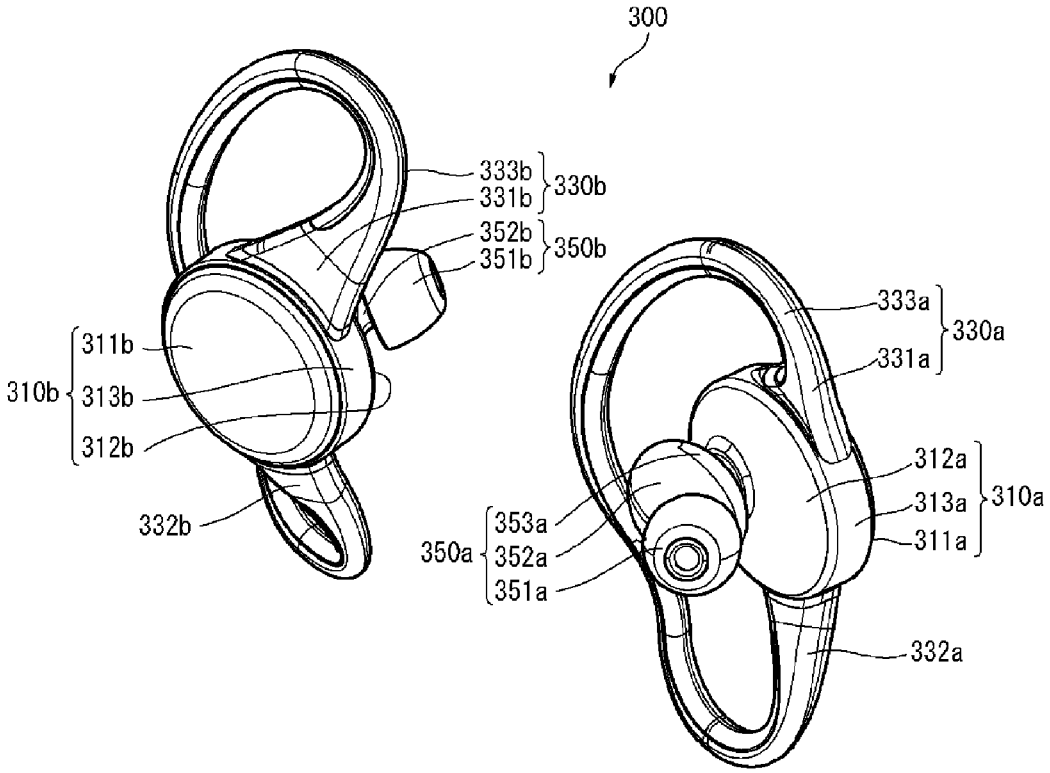
FIG. 27 is a view illustrating an electronic device according to another embodiment of the present disclosure.

Referring to FIG. 27, in an electronic device 300 according to another embodiment of the present disclosure, first and second bodies 310*a* and 310*b* may be wirelessly connected. The first body 310*a* may wirelessly receive data from the second body 310*b* and/or the second body 310*b* may wirelessly receive data from the first body 310*a*.

Although not shown, the first body 310*a* and the second body 310*b* may each include a power supply unit and a wireless communication unit. The power supply unit and the wireless communication unit have substantially the same components and functions as those of the power supply unit 121*b* (FIGS. 4, 5A, 5B) and the wireless communication unit 115*a* (FIGS. 2, 3A, 3B) described above, and thus, descriptions thereof will be omitted.

Also, components of wearing parts 330*a* and 330*b* and ear housing 350*a* and 350*b* are substantially the same as those of the wearing parts 130*a* and 130*b* and the ear housings 150*a* and 150*b* described above with reference to FIGS. 1, 2, 3A, 3B, 4, 5A, 5B, and thus, descriptions thereof will be omitted.

The first body 310*a* and the second body 310*b* are wirelessly connected to each other, and may be set as a master and a slave. When the first body 310*a* is set as a master, the second body 310*b* may be a slave, and when the second body 310*b* is set as a master, the first body 310*a* may be slave.

The electronic device 300 may set a body 310*a* or 310*b* in which a controller (not shown) and a memory (not shown) are disposed, among the first body 310*a* and the second body 310*b*, as a master. When the master is set, the other body 310*a* or 310*b* may be set as a slave.

Also, the electronic device 300 may set a body 310*a* or 310*b* in which a battery (not shown) having high capacity is disposed, among the first body 310*a* and the second body 310*b*, as a master. When the master is set, the other body 310*a* or 310*b* may be set as a slave. Thus, the electronic device 300 may first charge the first body 310*a* as a master under the control of the controller, and after the first body 310*a* is charged, the electronic device 300 may be controlled to charge the second body 310*b*.

In this manner, the electronic device 300 configured in a wireless manner may be paired with a user's mobile terminal through the first body 310*a* as a master. Pairing with the mobile terminal will be described later.

Also, although not shown, the electronic device 300 may include a notification member in the first body 310*a* and the second body 310*b*. The notification member may not operate when the first body 310*a* and the second body 310*b* are positioned within a set reference range. When the first body 310*a* or the second body 310*b* are not within the set reference range, the notification member may output a notification sound so that the user may recognize that the first body 310*a* and the second body 310*b* are separated.

Figure 28:
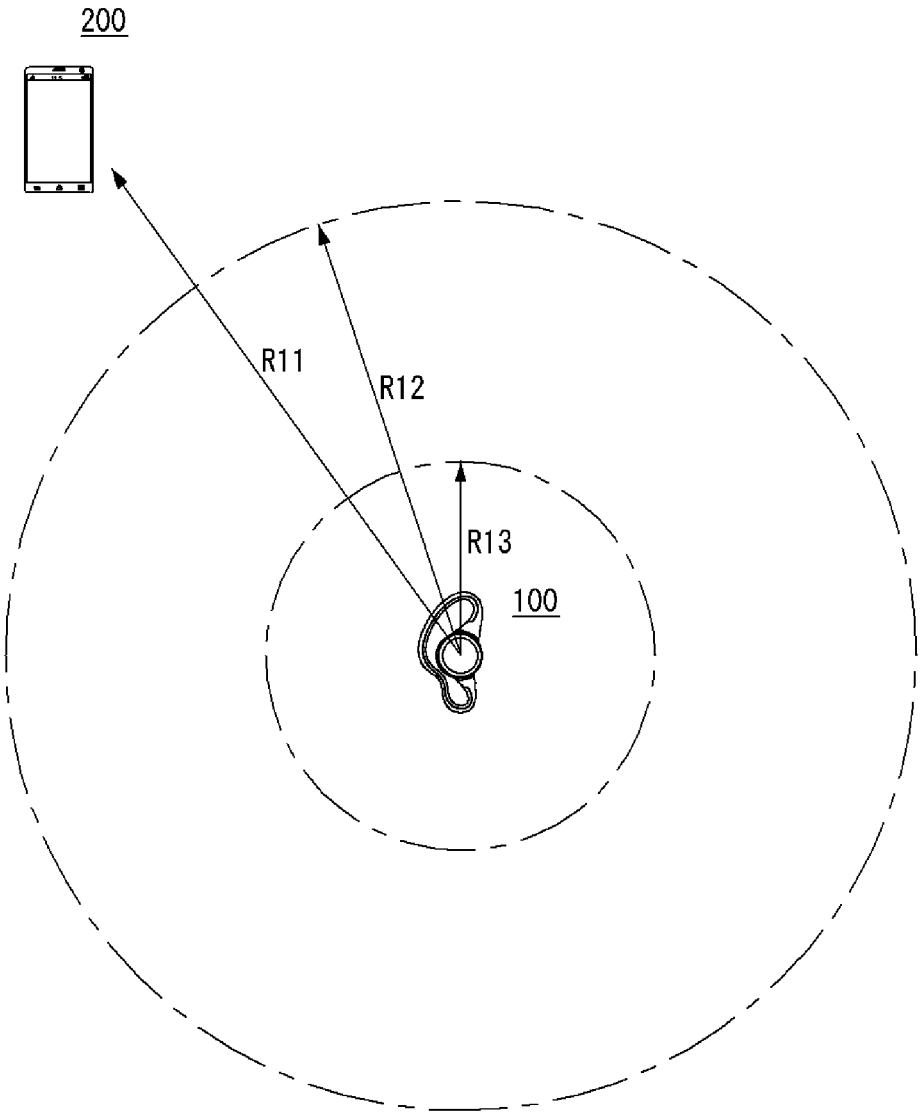
FIG. 28 is a view illustrating an electronic device according to another embodiment of the present disclosure.

As illustrated in FIG. 28, the electronic device 100 may be in a predetermined relationship with a mobile terminal 200. That is, the electronic device 100 may be in a state of being paired with the mobile terminal 200.

The electronic device 100 may be within a predetermined distance from the mobile terminal 200. The predetermined distance may include first to third distances R11 to R13. The electronic device 100 may perform different operations according to distances to the mobile terminal 200. When the electronic device 100 is at the first distance R11, the electronic device 100 may be turned off, when the electronic device 100 is at the second distance R12, the electronic device 100 may be turned on. When the electronic device 100 is at the third distance R13, the electronic device 100 may provide information about an accurate location. For example, the electronic device 100 may inform the user about an accurate location of the electronic device 100 through vibration at a predetermined interval, sound at a predetermined interval, and/or display at a predetermined interval.

As illustrated in FIGS. 29A, 29B, and 30-32, the electronic device 100 according to another embodiment of the present disclosure may perform a predetermined operation with the mobile terminal 200 of the user. The electronic device 100 may form a single system with the mobile terminal 200 and one of the electronic device 100 and the mobile terminal 200 may transmit a control signal to the other.

Figure 29A:
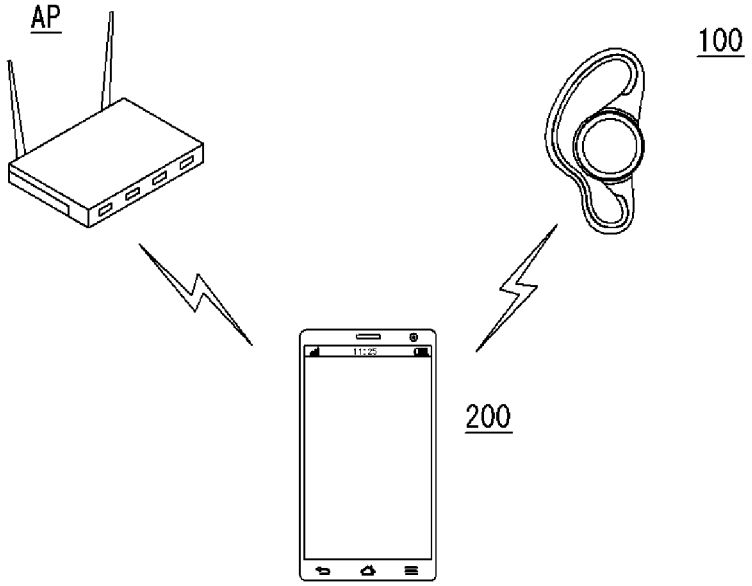
FIGS. 29A, 29B, and 30-33 are views illustrating operations of an electronic device according to another embodiment of the present disclosure.

As illustrated in FIG. 29A, the electronic device 100 may receive external data through the mobile terminal 200. The mobile terminal 200 may communicate with a base station (or an access point (AP)). The electronic device 100 may receive external data from the mobile terminal 200 through Bluetooth communication, or the like. That is, the mobile terminal 200 may process data received from an external device such as the AP and transmit the processed data to the electronic device 100.

Figure 29B:
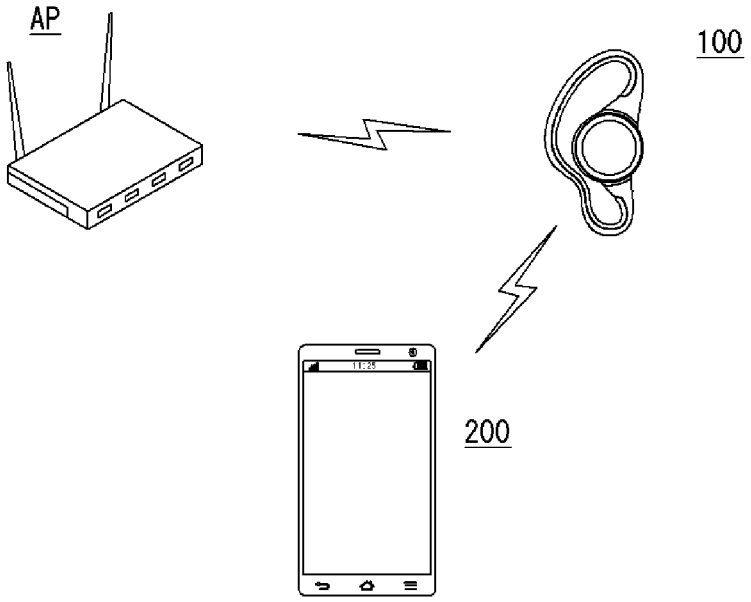

As illustrated in in FIG. 29B, the electronic device 100 may directly communicate with an external device. The electronic device 100 may receive data directly from the AP. The electronic device 100 may obtain data from the AP and transmit the data to the mobile terminal 200 using pairing.

Figure 30:
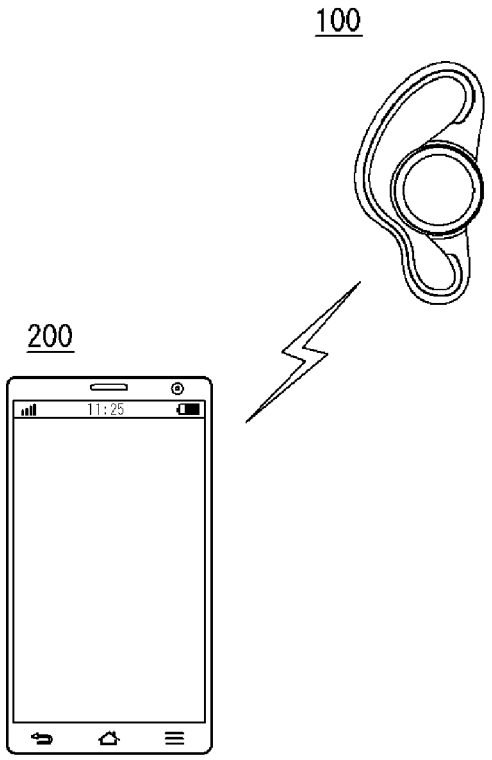

As illustrated in FIG. 30, the electronic device 100 may interwork with the mobile terminal 200 of the user. Here, interworking may refer to a state in which the electronic device 100 and the mobile terminal 200 exchange data.

Figure 31:
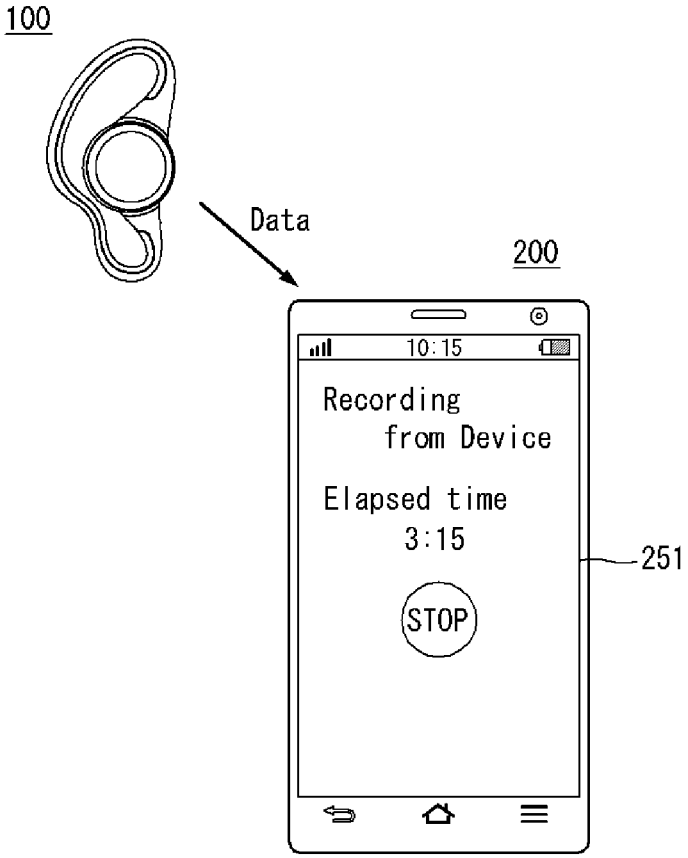

As illustrated in FIG. 31, the electronic device 100 may transmit data to the mobile terminal 200. For example, the user may perform a recording function using the electronic device 100. The electronic device 100 may have a memory having a least capacity required for an operation of the electronic device 100 or may have a memory with a small remaining capacity. The electronic device 100 may transmit recorded data to the mobile terminal 200. The mobile terminal 200 may store the recorded data transmitted from the electronic device 100. The mobile terminal 200 may display a storing situation of the recorded data received from the electronic device 100.

The electronic device 100 may transmit various types of data. The electronic device 100 may transmit biometric signal data of a user obtained through a heart rate sensor, or the like, movement data obtained through an accelerometer, or the like, to the mobile terminal 200. The electronic device 100 may have low data processing capability, relative to the mobile terminal 200. Thus, the electronic device 100 may transmit raw data to the mobile terminal, and the mobile terminal 200 may process the received raw data and inform the user accordingly.

Figure 32:
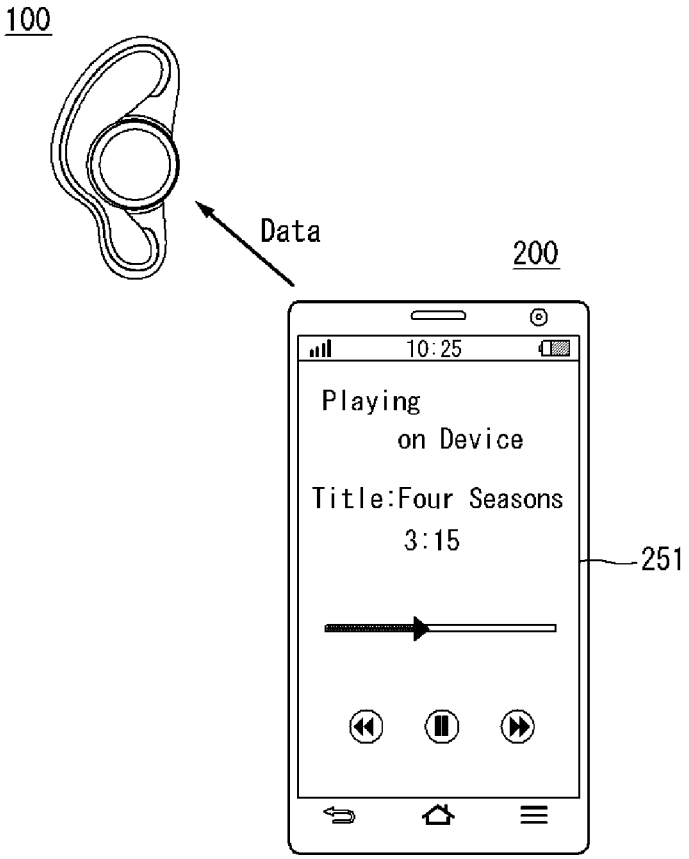

As illustrated in FIG. 32, the mobile terminal 200 may transmit data to the electronic device 100. The electronic device 100 may transmit sound data using a connected Bluetooth communication channel. Although the electronic device 100 does not retain a large amount of content therein, the electronic device 100 may obtain content required for reproduction from another device such as the mobile terminal 200 and output the obtained content.

Figure 33:
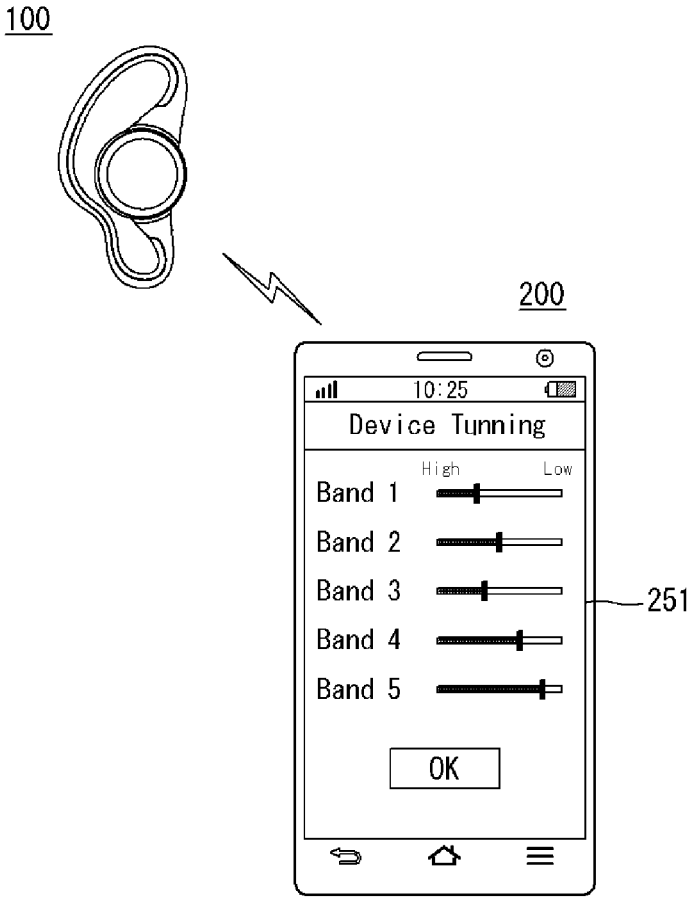

As illustrated in FIG. 33, the electronic device 100 may be controlled by the mobile terminal 200. The user may tune a speaker of the electronic device 100 using the mobile terminal 200.

The electronic device 100 may not have a display or may have a display too small to display sufficient information. The user may conveniently control the electronic device 100 using the mobile terminal 200 retaining a relatively large display 251.

The present invention described above may be implemented as a computer-readable code in a medium in which a program is recorded. The computer-readable medium includes any type of recording device in which data that can be read by a computer system is stored. The computer-readable medium may be, for example, a hard disk drive (HDD), a solid state disk (SSD), a silicon disk drive (SDD), a ROM, a RAM, a CD-ROM, a magnetic tape, a floppy disk, an optical data storage device, and the like. The computer-readable medium also includes implementations in the form of carrier waves (e.g., transmission via the Internet). Also, the computer may include a controller of a terminal.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An electronic device comprising:

a body;

a first support structured to move around an outer surface of the body, wherein the first support extends from the body along a line in a first direction;

a second support fixed to the body, wherein the second support extends from the body along a line in a second direction different from the first direction;

an ear loop extended from the first support to the second support, such that the ear loop forms a closed loop with the first support, the second support, and the body, wherein a shape of the ear loop changes according to a movement of the first support; and a tilting unit installed inside the body, wherein the tilting unit includes:

a damper-seated part being a plate and elongated along a region in which the first support is moved, wherein the damper-seated part includes ridges and valleys;

a damper controller elongated from a central axis of the body to the damper-seated part; and a damper member fixed to the damper controller between the damper controller and the damper-seated part to contact the ridges or the valleys of the damper-seated part and coupled with the first support, and wherein the damper member rotates in a clockwise direction or a counter-clockwise direction with respect to the central axis of the body.

2. The electronic device of claim 1, wherein the first support and the second support are offset relative to a side of the body to permit coupling of the ear loop to an inner side of cartilage of a user's ear.

3. The electronic device of claim 2, wherein the ear loop includes:

an ear-seated part extending from the first support and being bent to border an upper end of the inner side of the cartilage; and an ear support extending from the ear-seated part and being bent to border a lower end of the inner side of the cartilage.

4. The electronic device of claim 3, wherein the ear-seated part is concave relative to the body and the ear support is convex relative to the body.

5. The electronic device of claim 1, further comprising:

an ear housing sized to be inserted into a user's ear and is coupled to an inner side of the body.

6. The electronic device of claim 5, wherein a portion of the ear housing has a central axis that deviates from the central axis of the body.

7. The electronic device of claim 6, wherein the ear housing includes:

a first housing having an upper end and a lower end;

a second housing having an upper end and a lower end, wherein the upper end of the second housing is coupled to the lower end of the first housing and the lower end of the second housing is coupled to the inner side of the body;

a nozzle protruding from one side of the upper end of the first housing; and a speaker located within the first housing and the second housing, wherein the second housing forms an echo space within an internal space between the speaker and a surface of the inner side of the body.

8. The electronic device of claim 1, wherein the damper member includes:

a body fixed to the damper controller;

a elastic member spaced apart from the body;

a first buffer member extending to connect with the body and the elastic member; and a second buffer member extending to connect with the body and the elastic member and spaced apart from the first buffer member.

9. The electronic device of claim 1, wherein the elastic member includes a ridge to contact the damper-seated part such that the ridge of the elastic member is inserted into the valleys or pressed toward the body of the damper member when the damper member rotates in the clockwise direction or the counter-clock wise direction with respect to the central axis of the body.

10. The electronic device of claim 1, further comprising:

a waterproof member located between the first support and the body.

11. The electronic device of claim 1, wherein the body includes:

a molding member located between the first support and the second support and is shaped to allow cable to be drawn out therethrough, and wherein a drawn-out angle of the cable ranges from 25° to 35° with regard to a vertical direction.

12. The electronic device of claim 1, further comprising:

an ear housing sized to be inserted into a user's ear and is coupled to an inner side of the body, wherein the ear housing includes a patterned part surrounding a central region of the ear housing.

* * * * *